US010761452B2

(12) United States Patent
Shiomi et al.

(10) Patent No.: US 10,761,452 B2
(45) Date of Patent: Sep. 1, 2020

(54) DEVELOPING DEVICE INCLUDING A RESIN REGULATING BLADE

(71) Applicant: CANON KABUSHIKI KAISHA, Tokyo (JP)

(72) Inventors: Tomohiro Shiomi, Abiko (JP); Teruaki Tsurusaki, Moriya (JP); Shunichi Koga, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/122,633

(22) Filed: Sep. 5, 2018

(65) Prior Publication Data

US 2019/0072876 A1 Mar. 7, 2019

(30) Foreign Application Priority Data

Sep. 7, 2017 (JP) ..... 2017-172337
Aug. 3, 2018 (JP) ..... 2018-146714

(51) Int. Cl.
*G03G 15/08* (2006.01)
*G03G 15/09* (2006.01)

(52) U.S. Cl.
CPC . *G03G 15/0812* (2013.01); *G03G 2215/0634* (2013.01); *G03G 2215/1628* (2013.01)

(58) Field of Classification Search
CPC ..... G03G 15/0812
USPC ..... 399/274, 284
See application file for complete search history.

(56) References Cited

U.S. PATENT DOCUMENTS 10,048,646 B2 * 8/2018 Suzuki et al. ..... G03G 15/0812

FOREIGN PATENT DOCUMENTS

JP 2015-34929 A 2/2015
JP 2015-034930 A 2/2015

* cited by examiner

*Primary Examiner* — William J Royer
(74) *Attorney, Agent, or Firm* — Canon U.S.A., Inc. IP Division

(57) ABSTRACT

When the area of a developing frame member corresponding to the maximum image area of an image bearing member is, in a section perpendicular to a rotational axis of a developing rotary member, divided by a straight line passing through the center of rotation of the developing rotary member and the center of rotation of the image bearing member and a perpendicular line passing through the center of rotation of a first conveying screw with respect to the straight line, a gate portion is provided at a bottom portion of the developing frame member in a divided area of the developing frame member not provided with the attachment portion, and a gate portion is not provided at the bottom portion of the developing frame member in a divided area of the developing frame member provided with the attachment portion.

20 Claims, 16 Drawing Sheets

DEVELOPING DEVICE INCLUDING A RESIN REGULATING BLADE

BACKGROUND OF THE INVENTION

Field of the Invention

The present disclosure relates to a developing device including a resin regulating blade.

Description of the Related Art

A developing device described in Japanese Patent Laid-Open No. 2015-34929 includes a resin developer regulating member molded from resin, and a resin developing frame member molded from resin.

The developing device includes a developing frame member, a rotatable developer carrier configured to carry a developer to develop an electrostatic latent image formed on an image bearing member, and a regulating blade as a developer regulating member configured to regulate the amount of developer carried on the developer carrier. The regulating blade is, across a direction parallel to a rotational axis of the developer carrier, arranged facing the developer carrier through a predetermined gap (hereinafter referred to as a "SB gap") from the developer carrier. The SB gap is the minimum distance between the developer carrier and the regulating blade. The size of the SB gap is adjusted such that the amount of developer conveyed to a development area where the developer carrier faces the image bearing member is adjusted.

In association with an increase in the width of a sheet on which an image is formed, the length of the area (the maximum image area of the developing frame member) of the developing frame member corresponding to the maximum image area of an image area where an image can be formed on the image bearing member is increased in the direction parallel to the rotational axis of the developer carrier.

In a case where the developing frame member is molded from resin by injection molding, a gate portion as an inlet through which the resin flows into the molded article through a gate when the molten resin is poured into the molded article through the gate is provided at the developing frame member as the resin molded article. When a developing frame member with a great length in a longitudinal direction is molded from resin, a distance for circulating the molten resin is long, and therefore, the gate portion is typically provided in the maximum image area of the resin developing frame member such that the molten resin efficiently flows in the longitudinal direction of the developing frame member.

In a case where the developing frame member is molded from resin by injection molding, great molding pressure is on the gate portion when the molten resin flows into the gate portion through the gate, and therefore, residual stress is generated at the gate portion. The residual stress from the gate portion provided at the resin developing frame member is on the developing frame member over time, and deforms the resin developing frame member over time. As a result, in a state that the resin regulating blade is fixed to the resin developing frame member, the size of the SB gap might fluctuate over time due to the residual stress from the gate portion provided at the developing frame member.

SUMMARY OF THE INVENTION

An aspect of the present disclosure is to provide a developing device configured so that temporal fluctuation in the size of a SB gap due to residual stress from gate portions provided at a resin developing frame member can be reduced in a state that a resin regulating blade is fixed to the resin developing frame member.

Another aspect of the present disclosure is to provide a developing device including a developing rotary member configured to carry and convey a developer including toner and a carrier toward a position at which an electrostatic image formed on an image bearing member is developed; a resin regulating blade arranged facing the developing rotary member in a non-contact manner and configured to regulate the amount of the developer carried on the developing rotary member; a developing frame member at least including a first chamber where the developer is supplied to the developing rotary member, a second chamber divided from the first chamber by a partition wall, and an attachment portion for attachment of the regulating blade, the attachment portion being provided in the maximum image area of an image area of the image bearing member where an image can be formed on the image bearing member in a rotational axis direction of the developing rotary member; a first conveying screw arranged in the first chamber and configured to convey the developer of the first chamber in a first conveying direction; and a second conveying screw arranged in the second chamber and configured to convey the developer of the second chamber in a second conveying direction as the opposite direction of the first conveying direction. The regulating blade is fixed to the area of the attachment portion corresponding to the maximum image area of the image bearing member in the rotational axis direction of the developing rotary member in a state that the regulating blade is deflected such that a gap between the developing rotary member supported on the developing frame member and the regulating blade attached to the attachment portion falls within a predetermined range across the rotational axis direction of the developing rotary member. When the area of the developing frame member corresponding to the maximum image area of the image bearing member is, in a section perpendicular to a rotational axis of the developing rotary member, divided by a straight line passing through the center of rotation of the developing rotary member and the center of rotation of the image bearing member and a perpendicular line passing through the center of rotation of the first conveying screw with respect to the straight line, a gate portion is provided at a bottom portion of the developing frame member in a divided area of the developing frame member not provided with the attachment portion, and a gate portion is not provided at the bottom portion of the developing frame member in a divided area of the developing frame member provided with the attachment portion.

Further features of the present disclosure will become apparent from the following description of exemplary embodiments (with reference to the attached drawings).

DESCRIPTION OF THE EMBODIMENTS

Hereinafter, embodiments of the present disclosure will be described in detail with reference to the attached drawings. Note that the embodiments below are not intended to limit the present disclosure according to the scope of the claims, and all combinations of features described in a first embodiment are not necessarily essential for a solution according to the present disclosure. The present disclosure can be implemented for various use applications such as a printer, various printing machines, a copying machine, a FAX, and a multi-function machine.

[First Embodiment]

(Configuration of Image Forming Device)

Figure 1:
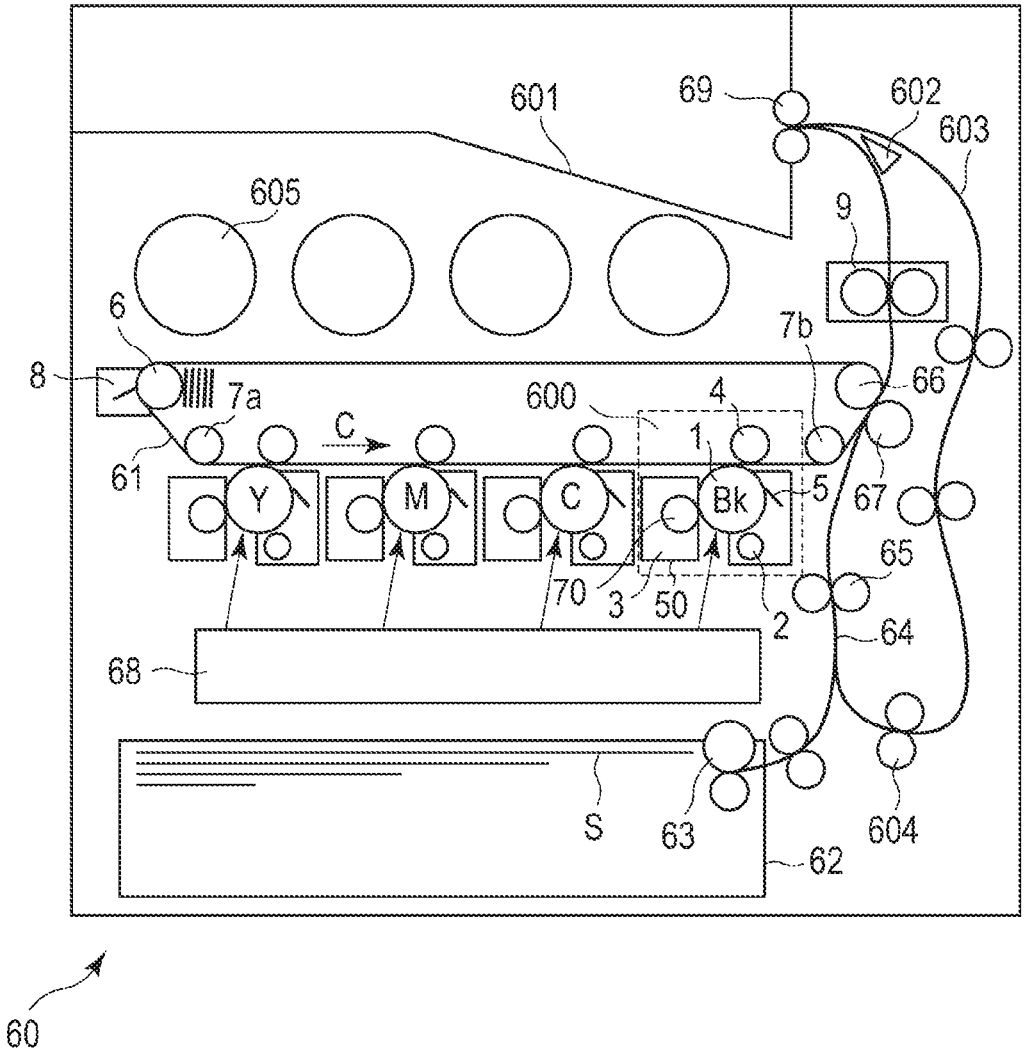
FIG. 1 is a sectional view of a configuration of an image forming device.

First, a configuration of an image forming device 60 according to the first embodiment of the present disclosure will be described with reference to a sectional view of FIG. 1. As illustrated in FIG. 1, the image forming device 60 includes an endless intermediate transfer belt (ITB) 61 as an intermediate transfer member, and includes four image forming units 600 from an upstream side to a downstream side along a rotation direction (the direction of an arrow C of FIG. 1) of the intermediate transfer belt 61. Each image forming unit 600 is configured to form a toner image in a corresponding one of yellow (Y), magenta (M), cyan (C), and black (Bk).

Each image forming unit 600 includes a rotatable photosensitive drum 1 as an image bearing member. Moreover, each image forming unit 600 includes a charging roller 2 as a charging unit, a developing device 3 as a developing unit, a primary transfer roller 4 as a primary transfer unit, and a photosensitive drum cleaner 5 as a photosensitive drum cleaning unit, these components being arranged along a rotation direction of the photosensitive drum 1.

Each developing device 3 is detachably attachable to the image forming device 60. Each developing device 3 has a developer container 50 configured to store a two-component developer (hereinafter simply referred to as a "developer") containing nonmagnetic toner (hereinafter simply referred to as "toner") and a magnetic carrier. Each of toner cartridges each configured to store the toner in the colors of Y, M, C, and Bk is detachably attachable to the image forming device 60. The toner in each color of Y, M, C, and Bk is supplied to a corresponding one of the developer containers 50 through a toner conveying path. Note that details of the developing device 3 will be described later with reference to FIGS. 2 to 4, and details of the developer container 50 will be described later with reference to FIG. 5.

The intermediate transfer belt 61 is stretched around a tension roller 6, a follower roller 7*a*, the primary transfer roller 4, a follower roller 7*b*, and an internal secondary transfer roller 66, and is conveyed and driven in the direction of the arrow C of FIG. 1. The internal secondary transfer roller 66 also serves as a drive roller configured to drive the intermediate transfer belt 61. In association with rotation of the internal secondary transfer roller 66, the intermediate transfer belt 61 rotates in the direction of the arrow C of FIG. 1.

The intermediate transfer belt 61 is pressed by the primary transfer roller 4 from a back side of the intermediate transfer belt 61. Moreover, the intermediate transfer belt 61 contacts the photosensitive drum 1 such that a primary transfer nip portion as a primary transfer portion is formed between the photosensitive drum 1 and the intermediate transfer belt 61.

An intermediate transfer body cleaner 8 as a belt cleaning unit contacts a position facing the tension roller 6 through the intermediate transfer belt 61. Moreover, an external secondary transfer roller 67 as a secondary transfer unit is arranged at a position facing the internal secondary transfer roller 66 through the intermediate transfer belt 61. The intermediate transfer belt 61 is pinched between the internal secondary transfer roller 66 and the external secondary transfer roller 67. Thus, a secondary transfer nip portion as a secondary transfer portion is formed between the external secondary transfer roller 67 and the intermediate transfer belt 61. At the secondary transfer nip portion, the toner image adsorbs to a surface of a sheet S (e.g., paper or a film) by application of predetermined pressing force and a transfer bias (an electrostatic load bias).

The sheet S is stored with the sheet S being stacked in a sheet storage unit 62 (e.g., a sheet cassette or a feeding deck). A feeding unit 63 is configured to feed the sheet S according to image formation timing by means of, e.g., a friction separation system using a feeding roller etc. The sheet S sent out by the feeding unit 63 is conveyed to a registration roller 65 arranged in the middle of a conveyance path 64. After skew correction or timing correction has been performed at the registration roller 65, the sheet S is conveyed to the secondary transfer nip portion. The timing at which the sheet S arrives at the secondary transfer nip portion coincides with the timing at which the toner image arrives at the secondary transfer nip portion, and the secondary transfer is performed.

A fixing device 9 is arranged on the downstream side of the secondary transfer nip portion in a conveying direction of the sheet S. The fixing device 9 applies a predetermined pressure and a predetermined amount of heat to the sheet S conveyed to the fixing device 9, and in this manner, the toner image is melted and fixed onto the surface of the sheet S. The sheet S on which the image has been fixed in this manner is directly discharged to a discharging tray 601 by forward rotation of a discharging roller 69.

In the case of performing two-sided image formation, the discharging roller 69 is rotated backward after the sheet S has been conveyed by forward rotation of the discharging roller 69 until a trailing end of the sheet S passes through a switching member 602. In this manner, the sheet S is conveyed to a two-sided printing conveyance path 603 with leading and trailing ends of the sheet S being switched.

Thereafter, the sheet S is, according to subsequent image formation timing, again conveyed to the conveyance path 64 by a re-feeding roller 604.

(Image Forming Process)

In image formation, the photosensitive drum 1 is rotatably driven by a motor. The charging roller 2 uniformly charges, in advance, a surface of the photosensitive drum 1 to be rotatably driven. An exposure device 68 forms, based on an image information signal input to the image forming device 60, an electrostatic latent image on the surface of the photosensitive drum 1 charged by the charging roller 2. The photosensitive drum 1 can form electrostatic latent images with multiple sizes.

The developing device 3 has a rotatable developing sleeve 70 as a developer carrier configured to carry the developer. The developing device 3 uses the developer carried on a surface of the developing sleeve 70 to develop the electrostatic latent image formed on the surface of the photosensitive drum 1. In this manner, the toner adheres to an exposure portion on the surface of the photosensitive drum 1, and is converted into a visible image. The transfer bias (the electrostatic load bias) is applied to the primary transfer roller 4, and therefore, the toner image formed on the surface of the photosensitive drum 1 is transferred onto the intermediate transfer belt 61. The toner (transfer residual toner) slightly remaining on the surface of the photosensitive drum 1 after primary transfer is collected by the photosensitive drum cleaner 5, and is again provided for a subsequent image formation process.

The image formation processing for each color as parallel processing by the image forming units 600 for the colors of Y, M, C, and Bk is performed at such timing that the toner image is superimposed in a sequential order on the toner image of the upstream color primarily transferred onto the intermediate transfer belt 61. As a result, the full-color toner image is formed on the intermediate transfer belt 61, and is conveyed to the secondary transfer nip portion. The transfer bias is applied to the external secondary transfer roller 67, and the toner image formed on the intermediate transfer belt 61 is transferred onto the sheet S conveyed to the secondary transfer nip portion. The toner (the transfer residual toner) slightly remaining on the intermediate transfer belt 61 after the sheet S has passed through the secondary transfer nip portion is collected by the intermediate transfer body cleaner 8. The fixing device 9 fixes the toner image transferred onto the sheet S. The sheet S subjected to fixing by the fixing device 9 is discharged to the discharging tray 601.

A series of image formation process as described above ends, and preparation for subsequent image formation operation is made.

(Configuration of Developing Device)

Figure 3:
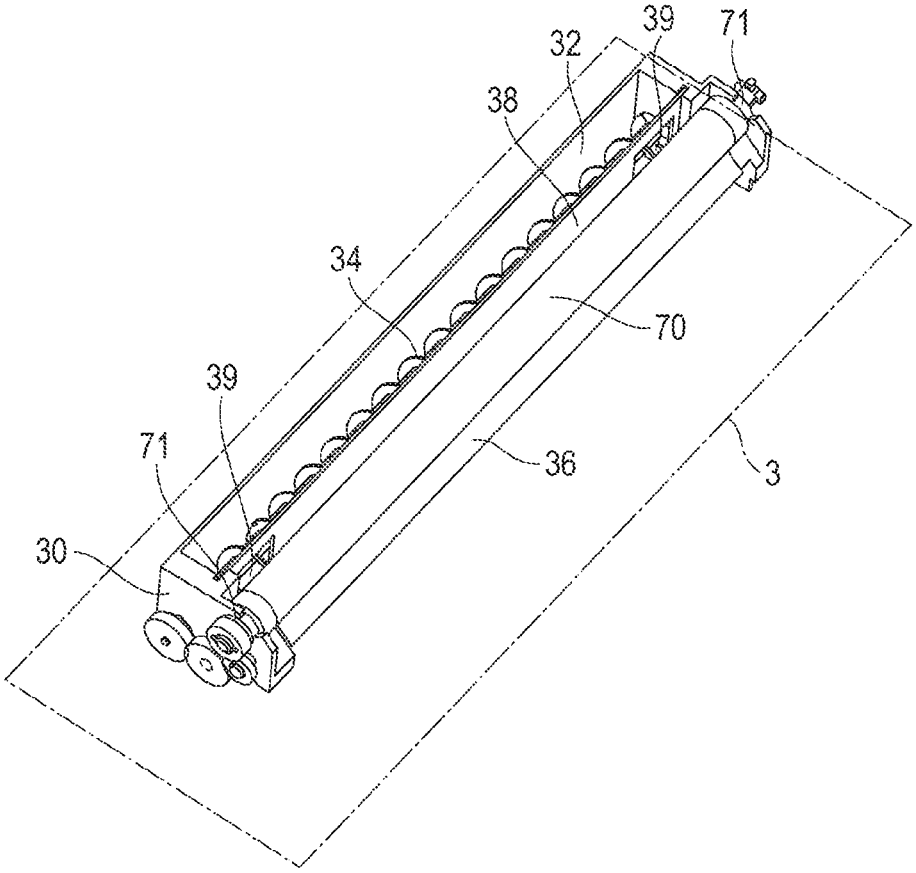
FIG. 3 is a perspective view of the configuration of the developing device.
Figure 4:
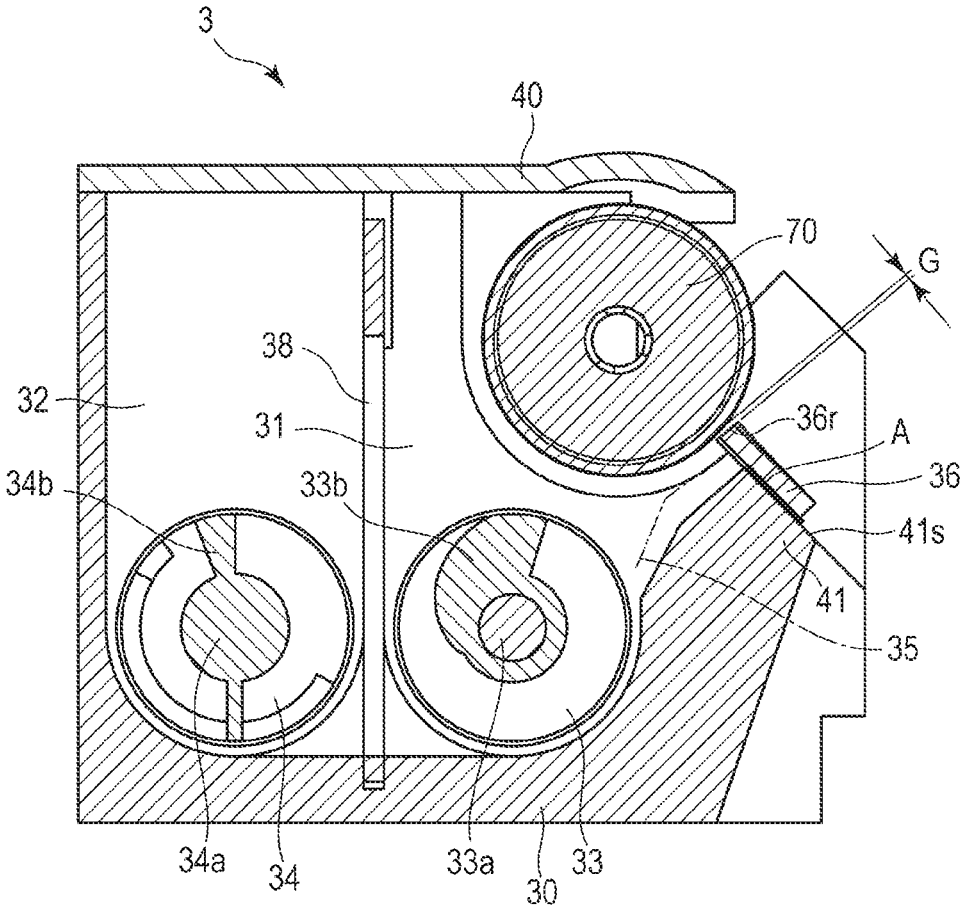
FIG. 4 is a sectional view of the configuration of the developing device.

A typical configuration of the developing device 3 will be described with reference to a perspective view of FIG. 2, a perspective view of FIG. 3, and a sectional view of FIG. 4. FIG. 4 is the sectional view of the developing device 3 in a section H of FIG. 2.

The developing device 3 includes the developer container 50 having a resin developing frame member (hereinafter simply referred to as a "developing frame member 30") molded from resin and a resin cover frame member (hereinafter simply referred to as a "cover frame member 40") formed separately from the developing frame member 30 and molded from resin. FIGS. 2 and 4 illustrate a state in which the cover frame member 40 is attached to the developing frame member 30, and FIG. 3 illustrates a state in which the cover frame member 40 is not attached to the developing frame member 30. Note that details of a configuration of the developing frame member 30 (a single member) will be described later with reference to FIG. 6.

At the developer container 50, an opening is provided at a position corresponding to a development area where the developing sleeve 70 faces the photosensitive drum 1. The developing sleeve 70 is rotatably arranged at the developer container 50 such that part of the developing sleeve 70 is exposed through the opening of the developer container 50. A bearing 71 as a bearing member is provided at each end portion of the developing sleeve 70.

The inside of the developer container 50 is, by a partition wall 38 extending in the vertical direction, divided into a development chamber 31 as a first chamber and a mixing chamber 32 as a second chamber. The development chamber 31 and the mixing chamber 32 are connected to each other at both ends in a longitudinal direction through two communication portions 39 of the partition wall 38. Thus, the developer can be communicated between the development chamber 31 and the mixing chamber 32 through the communication portions 39. The development chamber 31 and the mixing chamber 32 are arranged side by side in a horizontal direction.

In the developing sleeve 70, a magnet roll as a magnetic field generating unit having multiple magnetic poles along a rotation direction of the developing sleeve 70 and configured to generate a magnetic field for carrying the developer on the surface of the developing sleeve 70 is arranged in a fixed manner. The developer in the development chamber 31 is pumped up due to influence of the magnetic field by the magnetic poles of the magnet roll, and is supplied to the developing sleeve 70. Since the developer is supplied from the development chamber 31 to the developing sleeve 70 as described above, the development chamber 31 will be also referred to as a "supply chamber".

In the development chamber 31, a first conveying screw 33 as a conveying unit configured to mix and convey the developer in the development chamber 31 is arranged facing the developing sleeve 70. The first conveying screw 33 includes a rotary shaft **33*a* as a rotatable shaft portion, and a spiral blade portion 33*b* as a developer conveying unit provided along the outer periphery of the rotary shaft 33*a*. The first conveying screw 33 is rotatably supported on the developer container 50. A bearing member is provided at each end portion of the rotary shaft 33*a***.

Moreover, in the mixing chamber 32, a second conveying screw 34 as a conveying unit configured to mix the developer in the mixing chamber 32 and convey the developer in a direction opposite to that of the first conveying screw 33 is arranged. The second conveying screw 34 includes a rotary shaft **34*a* as a rotatable shaft portion, and a spiral blade portion 34*b* as a developer conveying unit provided along the outer periphery of the rotary shaft 34*a*. The second conveying screw 34 is rotatably supported on the developer container 50. A bearing member is provided at each end portion of the rotary shaft 34*a*. The first conveying screw 33 and the second conveying screw 34 are rotatably driven, and in this manner, a circulation path for circulating the developer is formed between the development chamber 31 and the mixing chamber 32 through the communication portions 39**.

In the developer container 50, a regulating blade (hereinafter referred to as a "doctor blade 36") as a developer regulating member configured to regulate the amount (also referred to as a "developer coating amount") of developer carried on the surface of the developing sleeve 70 is attached facing the surface of the developing sleeve 70 in a non-contact manner. The doctor blade 36 has a coating amount regulating surface **36*r* as a regulating unit configured to regulate the amount of developer carried on the surface of the developing sleeve 70. The doctor blade 36 is a resin doctor blade molded from resin. Note that a configuration of the doctor blade 36 (a single member) will be described later with reference to FIG. 5**.

The doctor blade 36 is arranged facing the developing sleeve 70 with a predetermined gap (hereinafter referred to as a "SB gap G") from the developing sleeve 70 across a longitudinal direction (i.e., a direction parallel to a rotational axis of the developing sleeve 70) of the developing sleeve 70. In the present disclosure, the SB gap G indicates the minimum distance between the maximum image area of the developing sleeve 70 and the maximum image area of the doctor blade 36. Note that the maximum image area of the developing sleeve 70 indicates the area of the developing sleeve 70 (the so-called maximum image area of the developing sleeve 70) corresponding to the maximum image area of an image area where an image can be formed on the surface of the photosensitive drum 1 in the direction parallel to the rotational axis of the developing sleeve 70. Moreover, the maximum image area of the doctor blade 36 indicates the area of the doctor blade 36 (the so-called maximum image area of the doctor blade 36) corresponding to the maximum image area of the image area where the image can be formed on the surface of the photosensitive drum 1 in the direction parallel to the rotational axis of the developing sleeve 70. In the first embodiment, the photosensitive drum 1 can form the electrostatic latent images with the multiple sizes, and therefore, the maximum image area indicates an image area corresponding to a largest one (e.g., an A3 size) of image areas with the multiple sizes formable on the photosensitive drum 1. On the other hand, in a variation in which an electrostatic latent image only with a single size can be formed on the photosensitive drum 1, the maximum image area is interpreted as an image area with the single size formable on the photosensitive drum 1.

The doctor blade 36 is substantially arranged facing a peak position of a magnetic flux density of the magnetic poles of the magnet roll. The developer supplied to the developing sleeve 70 is influenced by the magnetic field by the magnetic poles of the magnet roll. Moreover, the developer regulated and scraped off by the doctor blade 36 tends to be accumulated at an upstream portion of the SB gap G. As a result, a developer sump is formed on the upstream side of the doctor blade 36 in the rotation direction of the developing sleeve 70. Then, part of the developer in the developer sump is conveyed to pass through the SB gap G in association with rotation of the developing sleeve 70. At this point, the layer thickness of the developer passing through the SB gap G is regulated by the coating amount regulating surface **36*r* of the doctor blade 36. In this manner, a thin layer of the developer is formed on the surface of the developing sleeve 70**.

Then, a predetermined amount of developer carried on the surface of the developing sleeve 70 is conveyed to the development area in association with rotation of the developing sleeve 70. Thus, the size of the SB gap G is adjusted such that the amount of developer conveyed to the development area is adjusted. In the first embodiment, a target size (a so-called target value of the SB gap G) of the SB gap G upon adjustment of the size of the SB gap G is set to about 300 μm.

The developer conveyed to the development area magnetically stands up in the development area to form a magnetic brush. This magnetic brush comes into contact with the photosensitive drum 1 to supply the toner in the developer to the photosensitive drum 1. Then, the electrostatic latent image formed on the surface of the photosensitive drum 1 is developed as the toner image. The developer (hereinafter referred to as a developer after a developing step) on the surface of the developing sleeve 70 after the toner has been supplied to the photosensitive drum 1 through the development area is stripped off from the surface of the developing sleeve 70 by a repulsive magnetic field formed among the magnetic poles of the magnet roll with the same polarity. The developer after the developing step, which has been stripped off from the surface of the developing sleeve 70, drops into the development chamber 31, and is collected to the development chamber 31.

As illustrated in FIG. 4, a developer guide unit 35 configured to guide the developer such that the developer is conveyed toward the SB gap G is provided at the developing frame member 30. The developer guide unit 35 and the developing frame member 30 are configured integrally, and the developer guide unit 35 and the doctor blade 36 are configured separately. The developer guide unit 35 is formed in the developing frame member 30, and is arranged on the upstream side of the coating amount regulating surface **36*r* of the doctor blade 36 in the rotation direction of the developing sleeve 70. The flow of developer is stabilized by the developer guide unit 35, and is adjusted such that a predetermined developer density is provided. In this manner, the weight of the developer at such a position that the coating amount regulating surface 36*r* of the doctor blade 36 is closest to the surface of the developing sleeve 70** can be defined.

Moreover, as illustrated in FIG. 4, the cover frame member 40 is formed separately from the developing frame member 30, and is attached to the developing frame member 30. Further, the cover frame member 40 covers part of the opening of the developing frame member 30 such that part of an outer peripheral surface of the developing sleeve 70 is covered across an entire area in the longitudinal direction of the developing sleeve 70. In this state, the cover frame member 40 covers part of the opening of the developing frame member 30 such that the development area facing the photosensitive drum 1 of the developing sleeve 70 is exposed. In the first embodiment, the cover frame member 40 is fixed to the developing frame member 30 by ultrasonic bonding. However, the method for fixing the cover frame member 40 to the developing frame member 30 may be any method such as screw fastening, snap fitting, bonding, and welding. Note that regarding the cover frame member 40, the cover frame member 40 may be formed from a single component (a resin molded article) as illustrated in FIG. 4, or may be formed from multiple components (resin molded articles).

(Configuration of Resin Doctor Blade)

The configuration of the doctor blade 36 (the single member) will be described with reference to a perspective view of FIG. 5.

During the image formation operation (development operation), the pressure (hereinafter referred to as "developer pressure") of the developer generated from the flow of developer is on the doctor blade 36. When the developer pressure is on the doctor blade 36 during the image formation operation, tendency shows that lower stiffness of the doctor blade 36 results in more deformation of the doctor blade 36 and more fluctuation in the size of the SB gap G. During the image formation operation, the developer pressure acts in a widthwise direction (the direction of an arrow M of FIG. 5) of the doctor blade 36. For this reason, for reducing fluctuation in the size of the SB gap G during the image formation operation, the stiffness of the doctor blade 36 in the widthwise direction thereof is preferably increased such that resistance against deformation of the doctor blade 36 in the widthwise direction thereof is provided.

Figure 5:
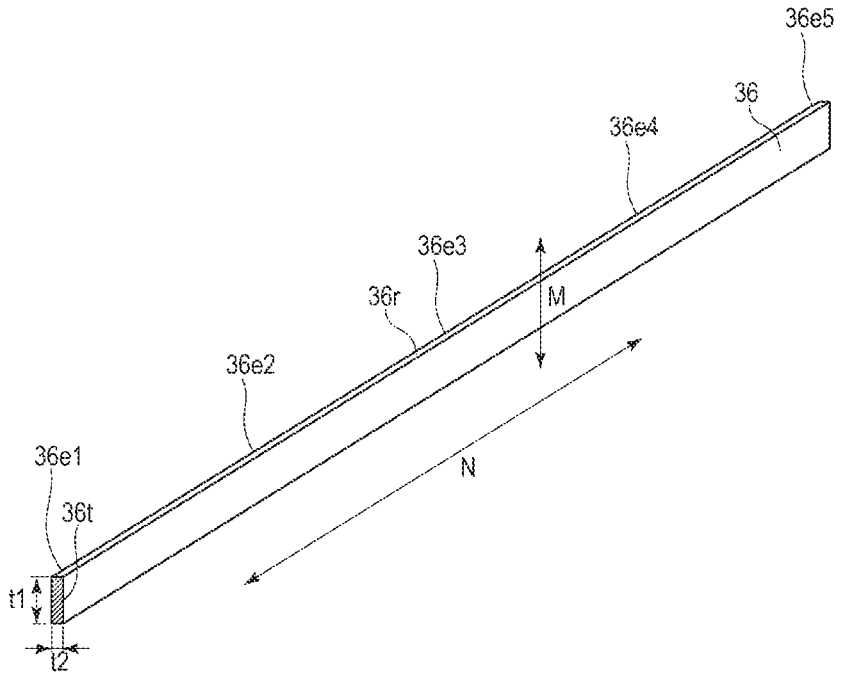
FIG. 5 is a perspective view of a configuration of a resin doctor blade (a single member).

As illustrated in FIG. 5, the shape of the doctor blade 36 is in a plate shape in the first embodiment, considering mass productivity and a cost. Moreover, as illustrated in FIG. 5, in the first embodiment, the sectional area of a side surface 36*t* of the doctor blade 36 is small, and a length $t_2$ of the doctor blade 36 in a thickness direction thereof is smaller than a length $t_1$ of the doctor blade 36 in the widthwise direction thereof. With this configuration, the doctor blade 36 (the single member) is configured easily deformable in the direction (the direction of the arrow M of FIG. 5) perpendicular to a longitudinal direction (the direction of an arrow N of FIG. 5) of the doctor blade 36. Thus, in the first embodiment, for correcting straightness of the coating amount regulating surface 36*r*, the doctor blade 36 is fixed to a blade attachment portion 41 of the developing frame member 30 with at least part of the doctor blade 36 being deflected in the direction of the arrow M of FIG. 5. Note that details of correction of the straightness of the doctor blade 36 will be described later with reference to FIG. 9.

(Configuration of Resin Developing Frame Member)

Figure 6:
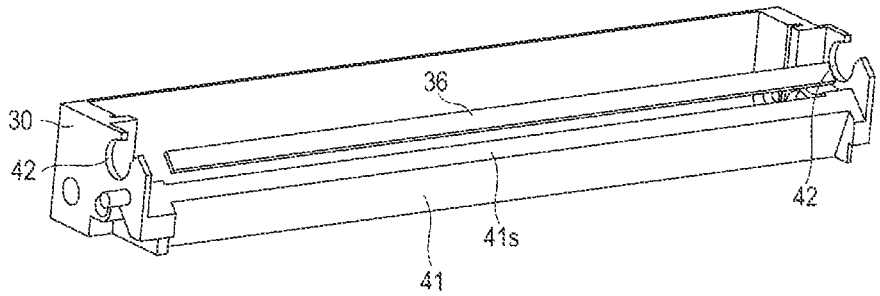
FIG. 6 is a perspective view of a configuration of a resin developing frame member (a single member).

The configuration of the developing frame member 30 (the single member) will be described with reference to a perspective view of FIG. 6. FIG. 6 illustrates a state in which the cover frame member 40 is not attached to the developing flame member 30.

The developing frame member 30 has the development chamber 31 and the mixing chamber 32 divided from the development chamber 31 by the partition wall 38. The partition wall 38 is molded from resin. The partition wall 38 may be configured separately from the developing frame member 30, or may be configured integrally with the developing frame member 30.

The developing frame member 30 has a sleeve support portion 42 configured to support the bearing 71 provided at each end portion of the developing sleeve 70 to rotatably support the developing sleeve 70. Moreover, the developing frame member 30 has the blade attachment portion 41 formed integrally with a sleeve support portion 42 and provided for attachment of the doctor blade 36. FIG. 6 illustrates a virtual state in which the doctor blade 36 is floating above the blade attachment portion 41.

In the first embodiment, in a state that the doctor blade 36 is attached to the blade attachment portion 41, an adhesive A applied to a blade attachment surface 41*s* of the blade attachment portion 41 is hardened, and in this manner, the doctor blade 36 is fixed to the blade attachment portion 41.

(Stiffness of Resin Doctor Blade)

The stiffness of the doctor blade 36 (the single member) will be described with reference to a schematic view of FIG. 7. The stiffness of the doctor blade 36 (the single member) is measured in a state that the doctor blade 36 is not fixed to the blade attachment portion 41 of the developing frame member 30.

Figure 7:
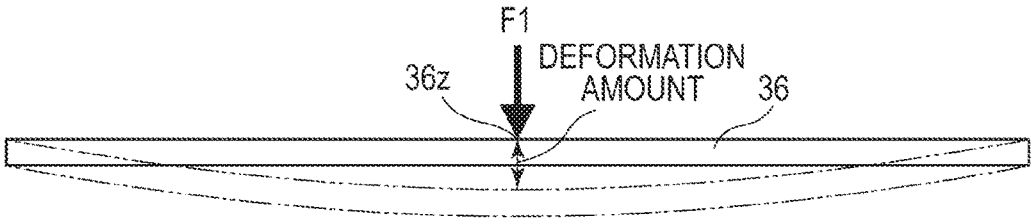
FIG. 7 is a schematic view for describing stiffness of the resin doctor blade (the single member).

As illustrated in FIG. 7, a concentrated load F1 is, in the widthwise direction of the doctor blade 36, on a center portion 36*z* of the doctor blade 36 in the longitudinal direction thereof. In this state, the stiffness of the doctor blade 36 (the single member) is measured based on the deflection amount of the center portion 36*z* of the doctor blade 36 in the widthwise direction thereof.

Suppose that a concentrated load F1 of 300 gf is, in the widthwise direction of the doctor blade 36, on the center portion 36*z* of the doctor blade 36 in the longitudinal direction thereof. In this case, the deflection amount of the center portion 36*z* of the doctor blade 36 in the widthwise direction thereof is equal to or greater than 700 μm. Note that in this state, the deformation amount of the center portion 36*z* of the doctor blade 36 in section is equal to or less than 5 μm.

(Stiffness of Resin Developing Frame Member)

Stiffness of the developing frame member 30 (the single member) will be described with reference to a schematic view of FIG. 8. The stiffness of the developing frame member 30 (the single member) is measured in a state that the doctor blade 36 is not fixed to the blade attachment portion 41 of the developing frame member 30.

Figure 8:
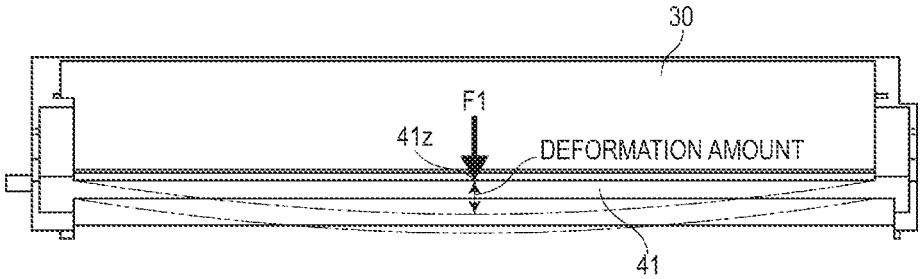
FIG. 8 is a schematic view for describing stiffness of the resin developing frame member (the single member).

As illustrated in FIG. 8, the concentrated load F1 is, in a widthwise direction of the blade attachment portion 41, on a center portion 41*z* of the blade attachment portion 41 in a longitudinal direction thereof. In this state, the stiffness of the developing frame member 30 (the single member) is measured based on the deflection amount of the center portion 41*z* of the blade attachment portion 41 in the widthwise direction thereof.

Suppose that a concentrated load F1 of 300 gf is, in the widthwise direction of the blade attachment portion 41, on the center portion 41*z* of the blade attachment portion 41 in the longitudinal direction thereof. In this case, the deflection amount of the center portion 41*z* of the blade attachment portion 41 in the widthwise direction thereof is equal to or less than 60 μm.

Suppose that the same level of concentrated load F1 is on the center portion 36*z* of the doctor blade 36 and the center portion 41*z* of the blade attachment portion 41 of the developing frame member 30. The deflection amount of the center portion 36*z* of the doctor blade 36 in this case is more than ten times as large as the deflection amount of the center portion 41*z* of the blade attachment portion 41. Thus, the stiffness of the developing frame member 30 (the single member) is more than 10 times as large as the stiffness of the doctor blade 36 (the single member). Thus, in a state that the doctor blade 36 is attached to the blade attachment portion 41 of the developing frame member 30 and is fixed to the blade attachment portion 41 of the developing frame member 30, the stiffness of the developing frame member 30 is dominant over the stiffness of the doctor blade 36. In the case of fixing to the developing frame member 30 across the entirety of the maximum image area of the doctor blade 36, the stiffness of the doctor blade 36 increases with the doctor blade 36 being fixed to the developing frame member 30 as compared to the case of fixing only both end portions of the doctor blade 36 in the longitudinal direction thereof.

Moreover, the level of the stiffness of the developing frame member 30 (the single member) is greater than the level of the stiffness of the cover frame member 40 (the single member). Thus, in a state that the cover frame member 40 is attached to the developing frame member 30 and is fixed to the developing frame member 30, the stiffness of the developing frame member 30 is dominant over the stiffness of the cover frame member 40.

(Correction of Straightness of Resin Doctor Blade)

In association with an increase in the width of the sheet S such as the A3 size being the width of the sheet S on which the image is formed, the length of the maximum image area of the image area where the image can be formed on the surface of the photosensitive drum 1 is increased in the direction parallel to the rotational axis of the developing sleeve 70. Thus, in association with an increase in the width of the sheet S on which the image is formed, the length of the maximum image area of the doctor blade 36 is increased. In the case of molding a doctor blade with a great longitudinal length from resin, it is difficult to ensure straightness of a coating amount regulating surface of the resin doctor blade molded from resin. This is because in the case of molding the doctor blade with the great longitudinal length from resin, when the thermally-expanded resin thermally contracts, a portion where thermal contraction progresses and a portion where thermal contraction is delayed are easily formed depending on a location in the longitudinal direction at the doctor blade.

Thus, in the resin doctor blade, tendency shows that a greater length of the doctor blade in the longitudinal direction thereof results in, due to the straightness of the coating amount regulating surface of the doctor blade, a more variable SB gap in a longitudinal direction of a developer carrier. With variation in the SB gap in the longitudinal direction of the developer carrier, there might be variation in the amount of developer carried on a surface of the developer carrier in the longitudinal direction thereof.

For example, in a case where a resin doctor blade (hereinafter referred to as a "resin doctor blade corresponding to the A3 size) whose length in the longitudinal direction corresponds to the A3 size is manufactured with the accuracy of a typical resin molded article, the straightness of the coating amount regulating surface is about 300 μm to 500 μm. Even if the resin doctor blade corresponding to the A3 size is manufactured with high accuracy by means of a high-accuracy resin material, the straightness of the coating amount regulating surface is about 100 μm to 200 μm.

In the first embodiment, the size of the SB gap G is set to about 300 μm, and the tolerance of the SB gap G (i.e., a tolerance with respect to the target value of the SB gap G) is set to equal to or lower than ±10%. Thus, in the first embodiment, it means that an adjustment value of the SB gap G is 300 μm±30 μm, and a value acceptable as the tolerance of the SB gap G is up to 60 μm. Thus, even when the resin doctor blade corresponding to the A3 size is manufactured with the accuracy of the typical resin molded article or with high accuracy by means of the high-accuracy resin material, only the accuracy of the straightness of the coating amount regulating surface exceeds a range acceptable as the tolerance of the SB gap G.

In the developing device including the resin doctor blade, the SB gap G preferably falls within a predetermined range across the direction parallel to the rotational axis of the developer carrier regardless of the straightness of the coating amount regulating surface in a state that the doctor blade is fixed to an attachment portion of a developing frame member. Thus, in the first embodiment, even when a resin doctor blade with low straightness of a coating amount regulating surface is used, the straightness of the coating amount regulating surface is corrected such that the SB gap G falls within a predetermined range across the direction parallel to the rotational axis of the developing sleeve 70 in a state that the doctor blade is fixed to an attachment portion of a developing frame member.

The straightness of the coating amount regulating surface 36*r* of the doctor blade 36 will be described with reference to a schematic view of FIG. 9. The straightness of the coating amount regulating surface 36*r* is represented by an absolute value of a difference between the maximum value and the minimum value of the outer shape of the coating amount regulating surface 36*r* with reference to a predetermined spot of the coating amount regulating surface 36*r* in a longitudinal direction thereof. Suppose that a center portion of the coating amount regulating surface 36*r* in the longitudinal direction thereof is an origin of an orthogonal coordinate system, a predetermined straight line passing through the origin is an X-axis, and a straight line drawn at right angle to the X-axis from the origin is a Y-axis. In this orthogonal coordinate system, the straightness of the coating amount regulating surface 36*r* is represented by an absolute value of a difference between the maximum value and the minimum value of a Y-coordinate of the outer shape of the coating amount regulating surface 36*r*.

Figure 9:
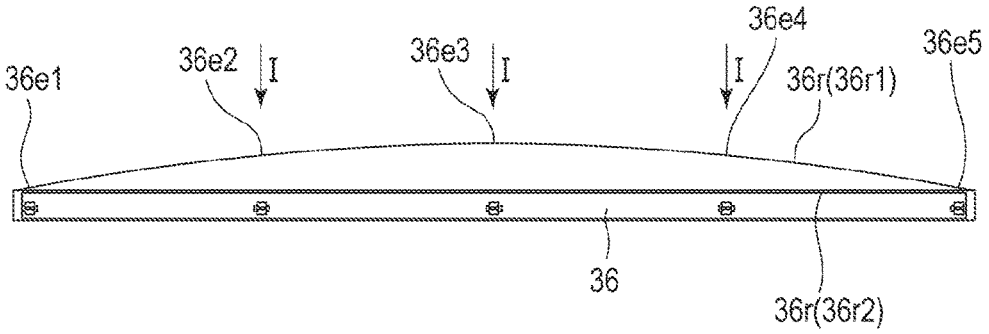
FIG. 9 is a schematic view for describing straightness of the resin doctor blade (the single member).

As illustrated in FIG. 9, the resin doctor blade (the single member) is in such a shape that the center portion of the coating amount regulating surface 36*r* of the doctor blade 36 in the longitudinal direction thereof is greatly deflected. Thus, a difference in the position of a tip end portion 36*e* (36*e*1 to 36*e*5) of the doctor blade 36 illustrated in FIG. 5 needs be reduced to correct the straightness of the coating amount regulating surface 36*r*. Considering, e.g., an acceptable value of the tolerance of the SB gap G and the accuracy of attachment of the doctor blade 36 to the developing frame member 30, the straightness of the coating amount regulating surface 36*r* of the doctor blade 36 needs to be corrected to equal to or less than 50 μm. Note that considering that the accuracy of straightness of a metal doctor blade by secondary cutting is equal to or less than 20 μm, the straightness of the coating amount regulating surface 36*r* of the resin doctor blade 36 is more preferably corrected to equal to or less than 20 μm. In the first embodiment, a set value for correction of the straightness of the coating amount regulating surface 36*r* of the doctor blade 36 is set to about 20 μm to 50 μm, considering a realistic mass production step.

Thus, in the first embodiment, force (also referred to as "straightness correction force") for deflecting at least part of the maximum image area of the doctor blade 36 is provided to the doctor blade 36 to deflect at least part of the maximum image area of the doctor blade 36. In this manner, the straightness of the coating amount regulating surface 36*r* of the doctor blade 36 is corrected to equal to or less than 50 μm.

In an example of FIG. 9, the straightness correction force is provided to the tip end portions 36*e*2, 36*e*3, and 36*e*4 in the direction of arrow I of FIG. 9 such that the outer shapes of the tip end portions 36*e*2, 36*e*3, and 36*e*4 fit the reference outer shapes of the tip end portions 36*e*1 and 36*e*5 of the doctor blade 36. As a result, the shape of the coating amount regulating surface 36*r* of the doctor blade 36 is corrected from a coating amount regulating surface 36*r*1 to a coating amount regulating surface 36*r*2, and therefore, the straightness of the coating amount regulating surface 36*r* of the doctor blade 36 can be corrected to equal to or less than 50 μm. Note that in the example of FIG. 9, the reference upon fitting of the outer shape of the tip end portion 36*e* of the doctor blade 36 is the outer shapes of the tip end portions 36*e*1 and 36*e*5 (both end portions of the coating amount regulating surface 36*r* in the longitudinal direction thereof), but may be the outer shape of the tip end portion 36*e*3 (the center portion of the coating amount regulating surface 36*r* in the longitudinal direction thereof). In this case, the straightness correction force is provided to the doctor blade 36 such that the outer shapes of the tip end portions 36*e*1, 36*e*2, 36*e*4, and 36*e*5 fit the reference outer shape of the tip end portion 36*e*3 of the doctor blade 36.

As described above, for performing correction of the straightness of the doctor blade 36, the stiffness of the doctor blade (the single member) needs to be decreased such that at least part of the maximum image area of the coating amount regulating surface 36*r* is deflected when the straightness correction force is provided to the doctor blade 36.

(Method for Adjusting SB Gap)

Adjustment of the SB gap G is performed in such a manner that the position of the doctor blade 36 relative to the developing frame member 30 is moved such that the position of the doctor blade 36 attached to the blade attachment portion 41 relative to the developing sleeve 70 supported on the sleeve support portion 42 is adjusted. The doctor blade 36 whose maximum image area is at least partially deflected is, at a predetermined position of the blade attachment portion 41 determined by adjustment of the SB gap G, fixed with the adhesive A applied in advance across the entirety of the maximum image area of the blade attachment surface 41*s*. Note that the maximum image area of the blade attachment surface 41*s* is the area of the blade attachment surface 41*s* corresponding to the maximum image area of the image area where the image can be formed on the surface of the photosensitive drum 1 in the direction parallel to the rotational axis of the developing sleeve 70. In this case, the area deflected for correcting the straightness of the coating amount regulating surface 36*r* in the maximum image area of the doctor blade 36 is fixed to the blade attachment portion 41. Note that when the area having received the force for deflecting at least part of the maximum image area of the doctor blade 36 is fixed to the blade attachment portion 41 with the adhesive A, no adhesive A may be applied to part of the blade attachment surface 41*s*. Application of the adhesive A across the entirety of the maximum image area of the blade attachment surface 41*s* indicates that the following conditions are satisfied: the area, which is deflected for correcting the straightness of the coating amount regulating surface 36*r*, of the area corresponding to the maximum image area of the doctor blade 36 is included, and the adhesive A is applied to 95% or more of the maximum image area of the blade attachment surface 41*s*.

With this configuration, restoring of the area, which is deflected for correcting the straightness of the coating amount regulating surface 36*r*, of the maximum image area of the doctor blade 36 from a deflected state to an original state before deflecting can be reduced. Thus, the doctor blade 36 is fixed to the blade attachment portion 41 with the straightness of the coating amount regulating surface 36*r* being corrected to equal to or less than 50 μm.

Note that in the first embodiment, the size of the SB gap G is measured (calculated) by a method described below. Note that measurement of the size of the SB gap G is performed in such a state in which the developing sleeve 70 is supported on the sleeve support portion 42 of the developing frame member 30, the doctor blade 36 is attached to the blade attachment portion 41 of the developing frame member 30, and the cover frame member 40 is fixed to the developing frame member 30.

For measuring the size of the SB gap G, a light source (e.g., an LED array or a light guide) is inserted into the development chamber 31 across a longitudinal direction thereof. The light source inserted into the development chamber 31 irradiates the SB gap G with light from the inside of the development chamber 31. Moreover, a camera configured to capture an image from a light beam emitted from the SB gap G to the outside of the developing frame member 30 is arranged at each of five spots corresponding to the tip end portions 36*e* (36*e*1 to 36*e*5) of the doctor blade 36.

The cameras arranged at these five spots are each configured to capture the image from the light beam emitted from the SB gap G to the outside of the developing frame member 30 to measure the positions of the tip end portions 36*e* (36*e*1 to 36*e*5) of the doctor blade 36. In this state, each camera reads a position at which the developing sleeve 70 is closest to the doctor blade 36 on the surface of the developing sleeve 70 and the tip end portion 36*e* (36*e*1 to 36*e*5) of the doctor blade 36. Subsequently, a pixel value is, from image data generated by reading by the cameras, converted into a distance, and the size of the SB gap G is calculated. In a case where the calculated size of the SB gap G does not fall within a predetermined range, adjustment of the SB gap G is performed. Then, when the calculated size of the SB gap G falls within the predetermined range, a position at which the doctor blade 36 whose maximum image area is at least partially deflected is fixed to the blade attachment portion 41 of the developing frame member 30 is determined.

Note that in the first embodiment, it is, by a method described below, determined whether or not the SB gap G falls within the predetermined range across the direction parallel to the rotational axis of the developing sleeve 70. First, the maximum image area of the doctor blade 36 is divided into four or more portions at equal intervals, and the SB gap G is measured at five or more spots in each divided portion (including both end portions and the center portion of the maximum image area of the doctor blade 36) of the doctor blade 36. Then, from samples of a measurement value of the SB gap G measured at five spots or more, the maximum value of the SB gap G, the minimum value of the SB gap G, and the median value of the SB gap G are extracted.

In this case, an absolute value of a difference between the maximum value of the SB gap G and the median value of the SB gap G may be equal to or less than 10% of the median value of the SB gap G, and an absolute value of a difference between the minimum value of the SB gap G and the median value of the SB gap G may be equal to or less than 10% of the median value of the SB gap G. In this case, the tolerance of the SB gap G is taken as equal to or less than ±10%, and a condition where the SB gap G falls within the predetermined range across the direction parallel to the rotational axis of the developing sleeve 70 is taken as satisfied. For example, in a case where the samples of the measurement value of the SB gap G measured at five or more spots show that the median value of the SB gap G is 300 μm, the maximum value of the SB gap G may be equal to or less than 330 μm, and the minimum value of the SB gap G may be equal to or greater than 270 μm. That is, in this case, the adjustment value of the SB gap G is 300 μm±30 μm, and a value of up to 60 μm is acceptable as the tolerance of the SB gap G.

(Linear Expansion Coefficient)

Subsequently, deformation of the doctor blade 36 and the developing frame member 30 due to a change in a temperature due to heat generated during the image formation operation will be described with reference to a perspective view of FIG. 10. The heat generated during the development operation includes, for example, heat generated upon rotation of a rotary shaft and the bearings 71 of the developing sleeve 70, heat generated upon rotation of the rotary shaft 33*a* of the first conveying screw 33 and the bearing members thereof and heat generated when the developer passes through the SB gap G. A temperature surrounding the developing device 3 is changed due to these types of heat generated during the image formation operation, and the temperatures of the doctor blade 36, the developing frame member 30, and the cover frame member 40 are also changed.

Figure 10:
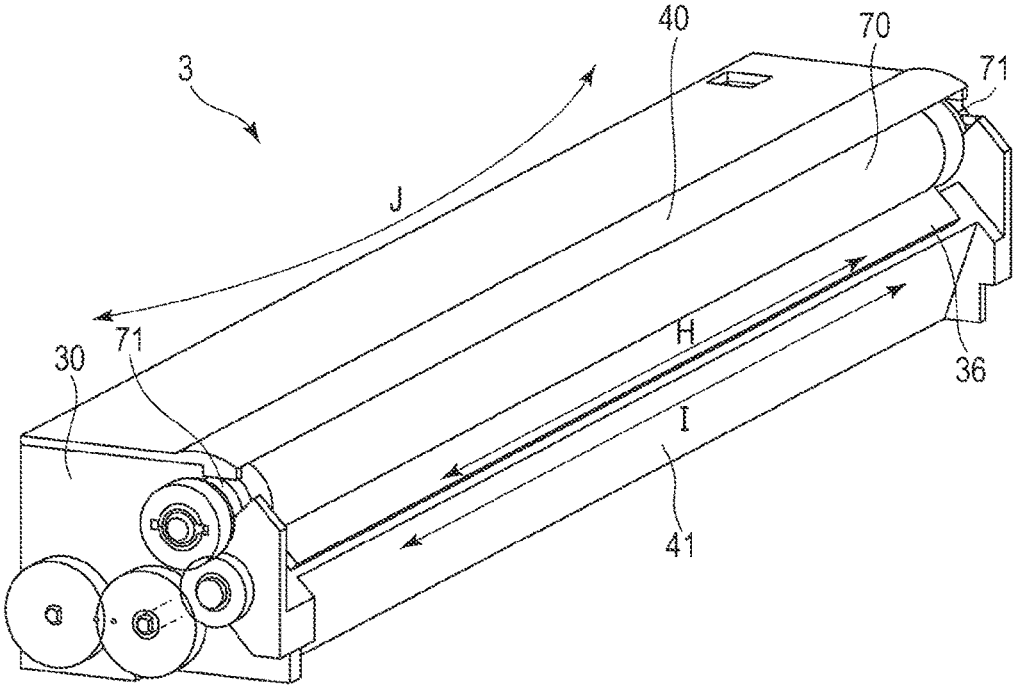
FIG. 10 is a perspective view for describing deformation of the resin doctor blade due to a temperature change.

As illustrated in FIG. 10, the stretching amount of the doctor blade 36 due to a temperature change is H [μm], and the stretching amount of the blade attachment surface 41*s* of the blade attachment portion 41 of the developing frame member 30 due to a temperature change is I [μm]. Moreover, the linear expansion coefficient $\alpha 1$ of resin forming the doctor blade 36 and the linear expansion coefficient $\alpha 2$ of resin forming the developing frame member 30 are different from each other. In this case, the deformation amount due to a temperature change is different between the developing frame member 30 and the doctor blade 36 because of a difference in the linear expansion coefficient. For filling a difference between H [μm] and I [μm], the doctor blade 36 deforms in the direction of an arrow J of FIG. 10. Deformation of the doctor blade 36 in the direction of the arrow J of FIG. 10 will be hereinafter referred to as "deformation in a warping direction of the doctor blade 36". Deformation in the warping direction of the doctor blade 36 leads to fluctuation in the size of the SB gap G. Reduction in fluctuation in the size of the SB gap G due to heat relates to the linear expansion coefficient α2 of resin forming the sleeve support portion 42 and the blade attachment portion 41 of the developing frame member 30 (the single member) and the linear expansion coefficient α1 of resin forming the doctor blade 36 (the single member). That is, in a case where the linear expansion coefficient α1 of resin forming the doctor blade 36 and the linear expansion coefficient α2 of resin forming the developing frame member 30 are different from each other, the deformation amount due to a temperature change varies due to a difference in the linear expansion coefficient.

Typically, a resin material has a greater linear expansion coefficient than that of a metal material. In a case where the doctor blade 36 is made of resin, warp deformation occurs at the doctor blade 36 in association with a temperature change due to the heat generated during the image formation operation, and therefore, the center portion of the doctor blade 36 in the longitudinal direction thereof is easily deflected. As a result, in the developing device configured such that the resin doctor blade 36 is fixed to the resin developing frame member, the size of the SB gap G easily fluctuates in association with a temperature change during the image formation operation.

(Configuration of Developing Device According to First Embodiment)

In the first embodiment, at least part of the maximum image area of the doctor blade 36 is deflected to correct the straightness of the coating amount regulating surface 36*r* to equal to or less than 50 μm. Moreover, a method is employed, in which the doctor blade 36 whose maximum image area is at least partially deflected is, with the adhesive A, fixed to the blade attachment portion 41 of the developing frame member 30 across the entirety of the maximum image area of the doctor blade 36.

In this case, when there is a great difference between the linear expansion coefficient α2 of resin forming the developing frame member 30 and the linear expansion coefficient α1 of resin forming the doctor blade 36, the following problem is caused when a temperature change occurs. That is, when a temperature change occurs, the deformation amount (the extension amount) of the doctor blade 36 due to a temperature change and the deformation amount (the extension amount) of the developing frame member 30 due to a temperature change are different from each other. As a result, even when a position at which the doctor blade 36 is attached to the blade attachment surface 41*s* of the developing frame member 30 is determined, even if the SB gap G is adjusted with high accuracy, the size of the SB gap G might fluctuate due to a temperature change during the image formation operation.

In the first embodiment, the doctor blade 36 is fixed to the blade attachment surface 41*s* across the entirety of the maximum image area, and therefore, fluctuation in the size of the SB gap G due to a temperature change during the image formation operation needs to be reduced. For reducing variation in the amount of developer carried on the surface of the developing sleeve 70 in the longitudinal direction thereof, the fluctuation amount of the SB gap G due to heat typically needs to be reduced to equal to or less than ±20 μm.

The difference of the linear expansion coefficient α2 of resin forming the developing frame member 30 having the sleeve support portion 42 and the blade attachment portion 41 from the linear expansion coefficient α1 of resin forming the doctor blade 36 will be hereinafter referred to as a "linear expansion coefficient difference α2−α1". A change in the maximum deflection amount of the doctor blade 36 due to the linear expansion coefficient difference α2−α1 will be described with reference to Table 1. In a state that the doctor blade 36 is fixed to the blade attachment portion 41 of the developing frame member 30 across the entirety of the maximum image area of the doctor blade 36, measurement of the maximum deflection amount of the doctor blade 36 when a temperature change from a normal temperature (23° C.) to a high temperature (40° C.) is provided was performed.

The linear expansion coefficient of resin forming the developing frame member 30 having the sleeve support portion 42 and the blade attachment portion 41 is α2 [m/° C.], and the linear expansion coefficient of resin forming the doctor blade 36 is α1 [m/° C.]. Results from measurement of the maximum deflection amount of the doctor blade 36 with a change in a parameter of the linear expansion coefficient difference α2−α1 are shown in Table 1. In Table 1, the maximum deflection amount is good (a white circle) in a case where an absolute value of the maximum deflection amount of the doctor blade 36 is equal to or less than 20 μm, and is poor (a cross mark) in a case where the absolute value of the maximum deflection amount of the doctor blade 36 is greater than 20 μm.

TABLE 1

| | LINEAR EXPANSION COEFFICIENT DIFFERENCE α2 − α1 [×10$^{-5}$ m/° C.] | | | | | | | | |
|---|---|---|---|---|---|---|---|---|---|
| | 0 | +0.20 | +0.40 | +0.50 | +0.54 | +0.55 | +0.56 | +0.57 | +0.60 |
| MAXIMUM DEFLECTION AMOUNT OF DOCTOR BLADE | ○ | ○ | ○ | ○ | ○ | ○ | X | X | X |

| | LINEAR EXPANSION COEFFICIENT DIFFERENCE α2 − α1 [×10$^{-5}$ m/° C.] | | | | | | | |
|---|---|---|---|---|---|---|---|---|
| | 0 | −0.20 | −0.40 | −0.44 | −0.45 | −0.46 | −0.47 | −0.50 |
| MAXIMUM DEFLECTION AMOUNT OF DOCTOR BLADE | ○ | ○ | ○ | ○ | ○ | X | X | X |

As seen from Table 1, the linear expansion coefficient difference $\alpha 2-\alpha 1$ needs to satisfy the following relational expression (Expression 1) for suppressing the fluctuation amount of the SB gap G due to heat to equal to or less than ±20 μm.

$$-0.45\times10^{-5}[\text{m/° C.}]\leq\alpha 2-\alpha 1\leq 0.55\times10^{-5}[\text{m/° C.}] \quad \text{(Expression 1)}$$

Thus, the resin forming the developing frame member 30 and the resin forming the doctor blade 36 may be selected such that the linear expansion coefficient difference $\alpha 2-\alpha 1$ is equal to or greater than $-0.45\times10^{-5}$ [m/° C.] and equal to or less than $0.55\times10^{-5}$ [m/° C.]. Note that in a case where the same resin is selected as the resin forming the developing frame member 30 and the resin forming the doctor blade 36, the linear expansion coefficient difference $\alpha 2-\alpha 1$ is zero.

Note that when the adhesive A is applied to the doctor blade 36 or the developing frame member 30, the linear expansion coefficient of the doctor blade 36 or the developing frame member 30 to which the adhesive A has been applied fluctuates. However, the volume of the adhesive A itself applied to the doctor blade 36 or the developing frame member 30 is extremely small, and is an ignorable level as influence on dimension fluctuation in a thickness direction of the adhesive A due to a temperature change. For this reason, when the adhesive A is applied to the doctor blade 36 or the developing frame member 30, deformation in the warping direction of the doctor blade 36 due to fluctuation in the linear expansion coefficient difference $\alpha 2-\alpha 1$ is at an ignorable level.

Similarly, the cover frame member 40 is fixed to the developing frame member 30, and therefore, deformation in the warping direction of the cover frame member 40 leads to fluctuation in the size of the SB gap G when the deformation amount due to a temperature change is different between the developing frame member 30 and the cover frame member 40. The linear expansion coefficient of resin forming the developing frame member 30 having the sleeve support portion 42 and the blade attachment portion 41 is $\alpha 2$ [m/° C.], and the linear expansion coefficient of resin forming the cover frame member 40 is $\alpha 3$ [m/° C.]. Moreover, a difference of the linear expansion coefficient $\alpha 3$ of resin forming the cover frame member 40 from the linear expansion coefficient $\alpha 2$ of resin forming the developing frame member 30 having the sleeve support portion 42 and the blade attachment portion 41 will be hereinafter referred to as a "linear expansion coefficient difference $\alpha 3-\alpha 2$". In this case, as in Table 1, the linear expansion coefficient difference $\alpha 3-\alpha 2$ needs to satisfy the following relational expression (Expression 2).

$$-0.45\times10^{-5}[\text{m/° C.}]\leq\alpha 3-\alpha 2\leq 0.55\times10^{-5}[\text{m/° C.}] \quad \text{(Expression 2)}$$

Thus, the resin forming the developing frame member 30 and the resin forming the cover frame member 40 may be selected such that the linear expansion coefficient difference $\alpha 3-\alpha 2$ is equal to or greater than $-0.45\times10^{-5}$ [m/° C.] and equal to or less than $0.55\times10^{-5}$ [m/° C.]. Note that in a case where the same resin is selected as the resin forming the developing frame member 30 and the resin forming the cover frame member 40, the linear expansion coefficient difference $\alpha 3-\alpha 2$ is zero.

(Developer Pressure)

Figure 11:
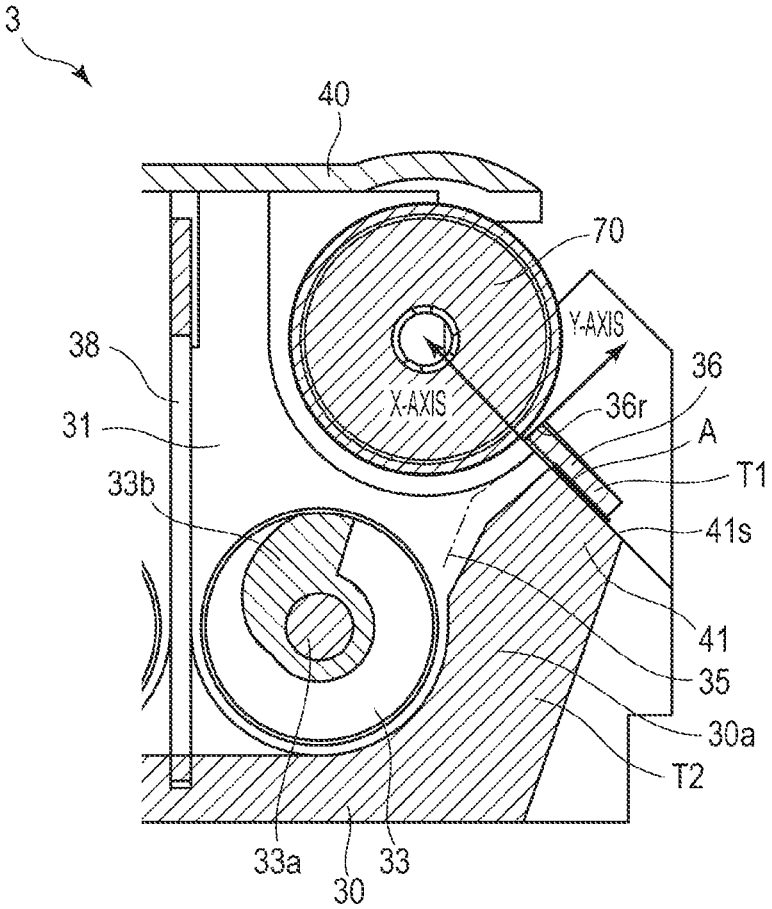
FIG. 11 is a sectional view for describing deformation of the resin doctor blade due to developer pressure.

Subsequently, deformation of the doctor blade 36 due to application of the developer pressure generated from the flow of developer to the doctor blade 36 during the image formation operation will be described with reference to a sectional view of FIG. 11. FIG. 11 is the sectional view of the developing device 3 in the section (the section H of FIG. 2) perpendicular to the rotational axis of the developing sleeve 70. Moreover, FIG. 11 illustrates a configuration of the vicinity of the doctor blade 36 fixed to the blade attachment portion 41 of the developing frame member 30 with the adhesive A.

As illustrated in FIG. 11, a line connecting the position of the coating amount regulating surface 36*r* closest to the developing sleeve 70 of the doctor blade 36 and the center of rotation of the developing sleeve 70 is the X-axis. In this case, the doctor blade 36 has a long length in an X-axis direction, and has high stiffness in a section along the X-axis direction. Moreover, as illustrated in FIG. 11, the percentage of a sectional area T1 of the doctor blade 36 with respect to a sectional area T2 of a wall portion 30*a* of the developing frame member 30 positioned close to the developer guide unit 35 is small.

As described above, in the first embodiment, the stiffness of the developing frame member 30 (the single member) is more than 10 times as large as the stiffness of the doctor blade 36 (the single member). Thus, in a state that the doctor blade 36 is fixed to the blade attachment portion 41 of the developing frame member 30, the stiffness of the developing frame member 30 is dominant over the doctor blade 36. As a result, the displacement amount (the maximum deflection amount) of the coating amount regulating surface 36*r* of the doctor blade 36 when the doctor blade 36 receives the developer pressure during the image formation operation is substantially equivalent to the displacement amount (the maximum deflection amount) of the developing frame member 30.

During the image formation operation, the developer pumped up from the first conveying screw 33 is conveyed onto the surface of the developing sleeve 70 through the developer guide unit 35. Thereafter, when the layer thickness of the developer is defined to the size of the SB gap G by the doctor blade 36, the doctor blade 36 also receives the developer pressure in various directions. As illustrated in FIG. 11, when a direction perpendicular to the X-axis direction (the direction of defining the SB gap G) is a Y-axis direction, the developer pressure in the Y-axis direction is perpendicular to the blade attachment surface 41*s* of the developing frame member 30. That is, the developer pressure in the Y-axis direction is force in the direction of detaching the doctor blade 36 from the blade attachment surface 41*s*. Thus, bonding force by the adhesive A needs to be sufficiently greater than the developer force in the Y-axis direction. For this reason, in the first embodiment, the bonding area and application thickness of the adhesive A on the blade attachment surface 41*s* are optimized considering the force of detaching the doctor blade 36 from the blade attachment surface 41*s* by the developer force and the bonding force of the adhesive A.

As described above, in the first embodiment, the resin doctor blade 36 is, with the adhesive A, fixed to the blade attachment portion 41 of the resin developing frame member 30 across the entirety of the maximum image area of the doctor blade 36. Moreover, in the first embodiment, when the resin doctor blade 36 is fixed to the blade attachment portion 41 of the resin developing frame member 30, the resin doctor blade 36 having low stiffness is used to perform correction of the straightness of the doctor blade 36 (the single member). Thus, in the developing device 3 configured such that the resin doctor blade 36 having low stiffness is fixed to the resin developing frame member 30, the stiffness of the resin developing frame member 30 (the single member) needs to be increased to increase the stiffness of the doctor blade 36 fixed to the developing frame member 30.

This is because the stiffness of the doctor blade 36 fixed to the developing frame member 30 is increased such that fluctuation in the SB gap G during the image formation operation is reduced and that the SB gap G falls within the predetermined range during the image formation operation.

For increasing the stiffness of the resin developing frame member 30 (the single member), the basic thickness of the developing frame member 30 might be increased. However, in a resin molded article having a basic thickness greater than a predetermined value, when resin thermally expanded upon molding thermally contracts, the degree of causing a difference in the progress of thermal contraction between the inside and outside of the resin molded article is easily increased as compared to a resin molded article having a basic thickness equal to or lower than the predetermined value. In other words, the molding contraction ratio of a resin molded article having a thickness size greater than a predetermined value becomes more non-uniform as compared to a resin molded article having a thickness size equal to or less than the predetermined value. This is because resin thermally expanded upon molding is gradually cooled from the outside of the resin molded article as a portion contacting a mold toward the inside of the resin molded article as a portion not contacting the mold, and thermal contraction progresses. Thus, in a case where the basic thickness size of the resin molded article is greater than the predetermined value, a sink mark tends to be more easily caused at the resin molded article as compared to a case where the basic thickness size of the resin molded article is equal to or less than the predetermined value.

Moreover, a cooling time or a cycle time upon molding is increased in association with an increase in the thickness size of the resin molded article, and therefore, this is disadvantageous considering mass productivity. For this reason, the degree of increasing the basic thickness size of the developing frame member 30 for the purpose of increasing the stiffness of the resin developing frame member 30 (the single member) is limited. Thus, in the first embodiment, the basic thickness size of the developing frame member 30 is set to equal to or greater than 1.0 mm and equal to or less than 3.0 mm such that no disadvantage is caused considering mass productivity. Moreover, the basic thickness size of the developing frame member 30 is preferably typically uniform such that the molding contraction ratio is not non-uniform.

The length of the maximum image area of the developing frame member 30 is increased in association with an increase in the width of the sheet S such as the A3 size being the width of the sheet S on which the image is formed. Note that the maximum image area of the developing frame member 30 is the area of the developing frame member 30 corresponding to the maximum image area of the image area where the image can be formed on the surface of the photosensitive drum 1 in the direction parallel to the rotational axis of the developing sleeve 70.

In a case where the developing frame member 30 is molded from resin by injection molding, gate portions 80 as inlets through which the resin flows into the molded article through gates when the molten resin is poured into the molded article through the gates are provided at the developing frame member 30 as the resin molded article. When the developing frame member 30 having a great length in the longitudinal direction is molded from resin, a distance for circulating the molten resin is long, and therefore, the gate portions 80 are typically provided at the maximum image area of the resin developing frame member 30 such that the molten resin efficiently flows in the longitudinal direction of the developing frame member 30. Note that the gate portions 80 can be typically viewed as marks (so-called gate marks) fulfilling a role as the inlets through which the molten resin flows into the molded article through the gates when an outer appearance of the resin developing frame member 30 is viewed.

Moreover, in a case where the developing frame member 30 is molded from the resin by injection molding, great molding pressure is on the gate portions 80 when the molten resin flows into the gate portions 80 through the gates, and therefore, residual stress is generated at the gate portions 80. The residual stress from the gate portions 80 provided at the resin developing frame member 30 is on the developing frame member 30 over time, and deforms the resin developing frame member 30 over time. As a result, in a state that the resin doctor blade 36 is fixed to the resin developing frame member 30, the size of the SB gap G due to the residual stress from the gate portions 80 provided at the developing frame member 30 might fluctuate over time.

The residual stress on the developing frame member 30 has a component on the developing frame member 30 along a direction intersecting the rotational axis of the developing sleeve 70. Note that the direction intersecting the rotational axis of the developing sleeve 70 includes not only a direction perpendicular to the rotational axis of the developing sleeve 70, but also a direction at an angle (note that an acute angle) of greater than 5° and less than 90° with respect to the rotational axis of the developing sleeve 70. When the component of the residual stress on the developing frame member 30 along the direction intersecting the rotational axis of the developing sleeve 70 is on the developing frame member 30 over time, the developing frame member 30 fixed to the doctor blade 36 is distorted along the direction intersecting the rotational axis of the developing sleeve 70. Thus, this contributes to fluctuation in the size of the SB gap G due to the residual stress (the component of the residual stress on the developing frame member 30 along the direction intersecting the rotational axis of the developing sleeve 70) from the gate portions 80.

As described above, it has been demanded to reduce fluctuation in the SB gap G during the image formation operation in a state that the resin doctor blade 36 having low stiffness is fixed to the resin developing frame member 30. Thus, in a state that the resin doctor blade 36 having low stiffness is fixed to the resin developing frame member 30, fluctuation in the size of the SB gap G in association with temporal application of the residual stress from the gate portions 80 provided at the maximum image area of the developing frame member 30 to the developing frame member 30 is preferably reduced. For this reason, the positions of the gate portions 80 at the maximum image area of the developing frame member 30 are designed such that fluctuation in the size of the SB gap G due to the residual stress from the gate portions 80 is reduced in a state that the resin doctor blade 36 having low stiffness is fixed to the resin developing frame member 30.

In the first embodiment, the gate portions 80 are provided at the maximum image area of the developing frame member 30 such that fluctuation in the size of the SB gap G due to the residual stress from the gate portions 80 is reduced in a state that the resin doctor blade 36 having low stiffness is fixed to the resin developing frame member 30. Details will be described below.

Figure 12:
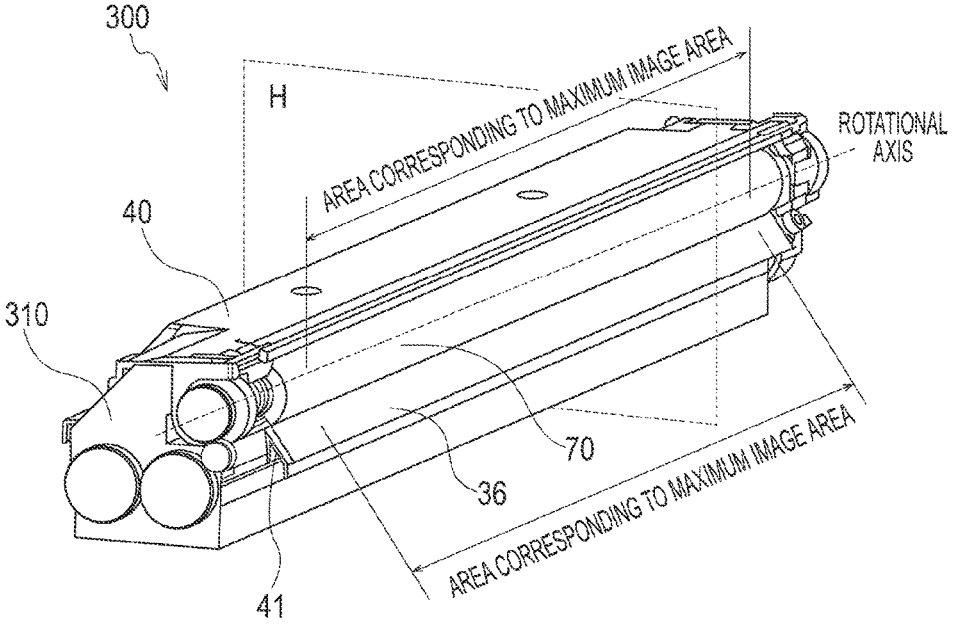
FIG. 12 is a perspective view of a configuration of a developing device according to a first embodiment.
Figure 13:
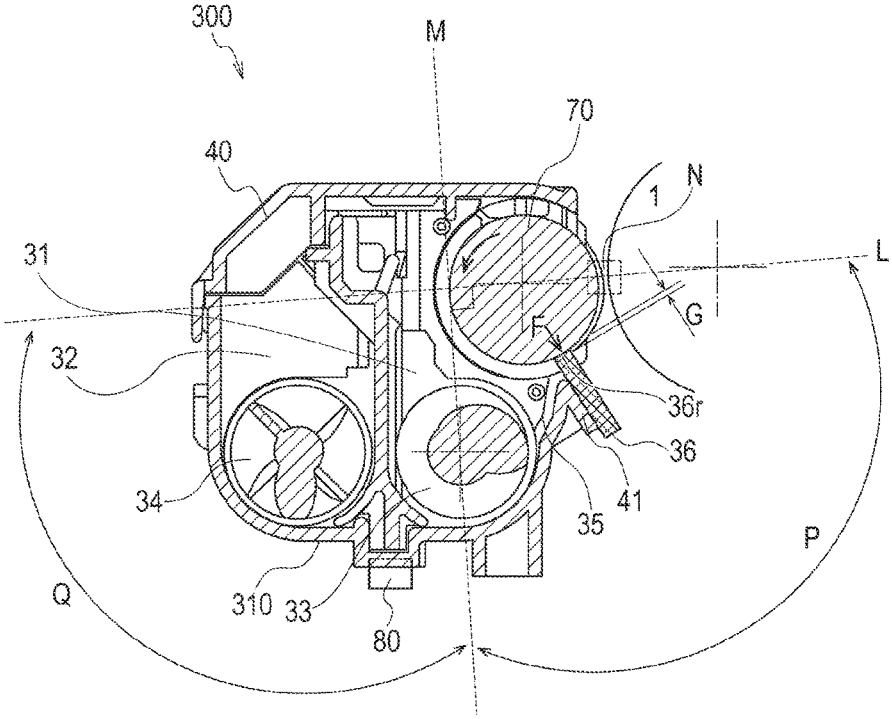
FIG. 13 is a sectional view of the configuration of the developing device according to the first embodiment.
Figure 14:
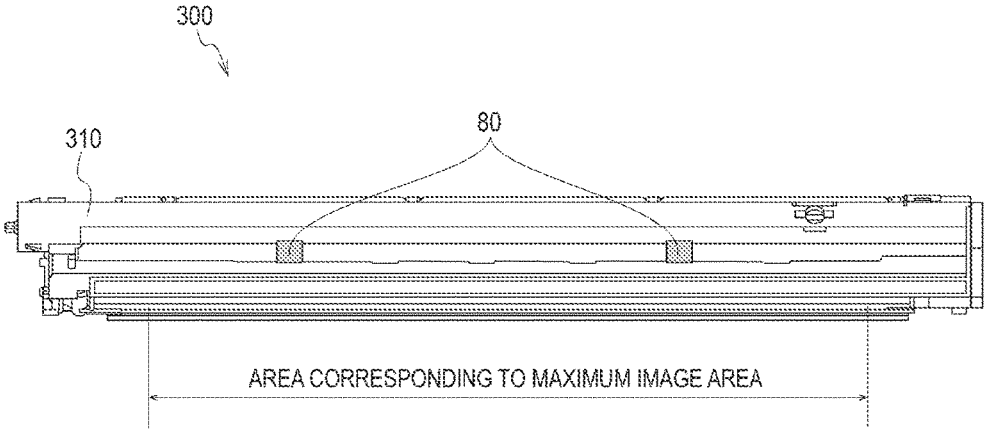
FIG. 14 is a lower view of the configuration of the developing device according to the first embodiment.

The configuration of the developing device according to the first embodiment will be described with reference to a perspective view of FIG. 12, a sectional view of FIG. 13, and a lower view of FIG. 14. FIG. 12 illustrates the maximum image area of a developing frame member 310 provided at a developing device 300 according to the first embodiment. FIG. 13 is the sectional view of the developing device 300 in a section H (the maximum image area of the developing frame member 310) of FIG. 12. FIG. 14 is the lower view of the developing device 300 when the developing device 300 attached to the image forming device 60 is viewed from below in the vertical direction. In each of FIGS. 12, 13, and 14, the same numerals are used to represent the same configurations as those of FIGS. 2, 3, and 4. Differences of the configuration of the developing device 300 (the configuration of the developing frame member 310) from the configuration (the configuration of the developing frame member 30) of the developing device 3 described above with reference to each of FIGS. 2, 3, and 4 will be mainly described.

In the first embodiment, the gate portions 80 are not provided at a bottom portion of the developing frame member 310 in the maximum image area in an area P of the developing frame member 310, and are provided at the bottom portion of the developing frame member 310 in the maximum image area in an area Q of the developing frame member 310, as illustrated in FIGS. 13 and 14. Note that the bottom portion of the developing frame member 310 described in the first embodiment is not limited to an outer wall portion (e.g., an outer wall portion positioned at a bottom portion of the partition wall 38) positioned on the lowermost side of the developing frame member 310 in the vertical direction when the developing sleeve 70 is at such a position that an electrostatic image formed on the photosensitive drum 1 is developed. Further, the bottom portion of the developing frame member 310 includes not only an outer wall portion positioned at a U-shaped bottom surface of the development chamber 31 and an outer wall portion positioned on a U-shaped bottom surface of the mixing chamber 32, but also an outer wall portion positioned at a U-shaped side wall surface of the development chamber 31 and an outer wall portion positioned at a U-shaped side wall surface of the mixing chamber 32.

When the developing device 300 is viewed in the section perpendicular to the rotational axis of the developing sleeve 70, the developing frame member 310 is divided into multiple areas by a straight line L passing through the center of rotation of the developing sleeve 70 and a closest position N and a perpendicular line M passing through the center of rotation of the first conveying screw 33 with respect to the straight line L. Note that the closest position N is a position at which the developing sleeve 70 is closest to the photosensitive drum 1. That is, as illustrated in FIG. 13, the straight line L is a straight line passing through the center of rotation of the developing sleeve 70 and the center of rotation of the photosensitive drum 1. Of the multiple divided areas of the developing frame member 310, the divided area of the developing frame member 310 provided with the blade attachment portion 41 is the area P of the developing frame member 310. In other words, the area P of the developing frame member 310 is an area covering 0 degrees to 90 degrees on the upstream side of the closest position N in the rotation direction of the developing sleeve 70. Of the multiple divided areas of the developing frame member 310 in this state, the divided area of the developing frame member 310 not provided with the blade attachment portion 41 is the area Q of the developing frame member 310. In other words, the area Q of the developing frame member 310 is an area covering 90 degrees to 180 degrees on the upstream side of the closest position N in the rotation direction of the developing sleeve 70.

As described above, in the first embodiment, the gate portions 80 are provided at the bottom portion of the developing frame member 310 in the maximum image area in the area Q of the developing frame member 310, and the positions of the gate portions 80 at the maximum image area of the developing frame member 310 are sufficiently apart from the maximum image area of the blade attachment portion 41. Thus, the degree of contribution of the residual stress from the gate portions 80 provided at the bottom portion of the developing frame member 310 in the maximum image area in the area Q of the developing frame member 310 to fluctuation in the size of the SB gap G is sufficiently small. On the other hand, in the first embodiment, the gate portions 80 are not provided at the bottom portion of the developing frame member 310 in the maximum image area in the area P of the developing frame member 310. Thus, influence of contribution of the residual stress generated due to the gate portions 80 provided at the bottom portion of the developing frame member 310 in the maximum image area in the area P of the developing frame member 310 to fluctuation in the size of the SB gap G is not necessarily taken into consideration.

Thus, in the first embodiment, fluctuation in the size of the SB gap G in association with temporal application of the residual stress from the gate portions 80 to the developing frame member 310 in a state that the resin doctor blade 36 having low stiffness is fixed to the resin developing frame member 310 can be reduced.

(Comparative Example)

Figure 15:
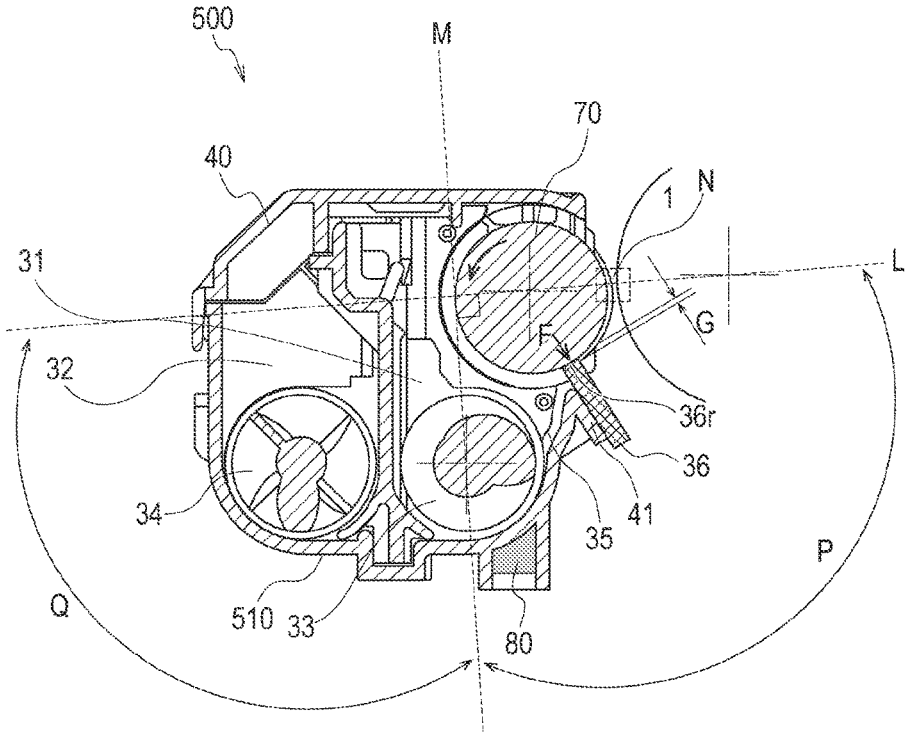
FIG. 15 is a perspective view of a configuration of a developing device according to a comparative example.
Figure 16:
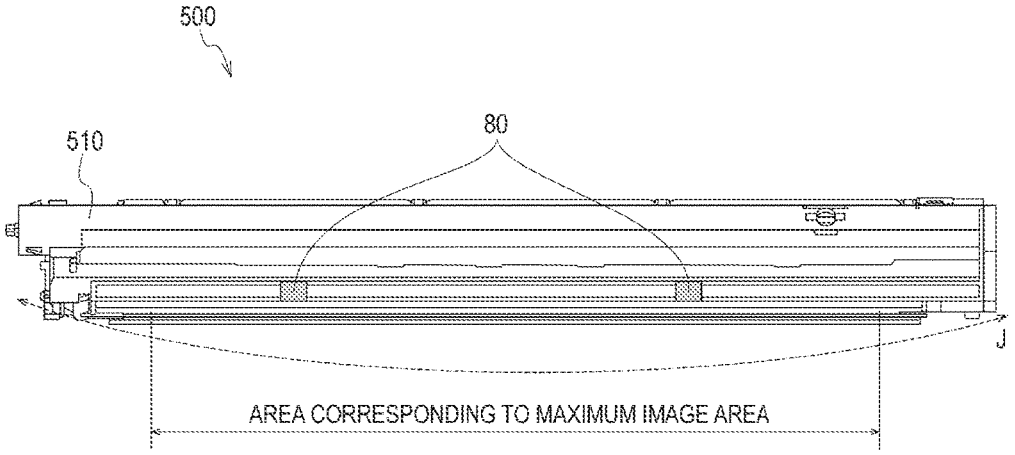
FIG. 16 is a sectional view of the configuration of the developing device according to the comparative example.

Subsequently, a configuration of a developing device 500 according to a comparative example will be described with reference to a sectional view of FIG. 15 and a lower view of FIG. 16. FIG. 15 is the sectional view of the developing device 500 in the section H (the maximum image area of a developing frame member 510) of FIG. 12. FIG. 16 is the lower view of the developing device 500 when the developing device 500 attached to the image forming device 60 is viewed from below in the vertical direction. In each of FIGS. 15 and 16, the same numerals are used to represent the same configurations as those of FIGS. 13 and 14. An area P illustrated in FIG. 15 is illustrated as the same area as the area P illustrated in FIG. 13. Moreover, an area Q illustrated in FIG. 15 is illustrated as the same area as the area Q illustrated in FIG. 13. Differences of the configuration (the configuration of the developing frame member 510) of the developing device 500 according to the comparative example from the configuration (the configuration of the developing frame member 310) of the developing device 300 according to the first embodiment described above with reference to each of FIGS. 13 and 14 will be mainly described. Note that subsequent description will be made with a definition of a bottom portion of the developing frame member 510 described in the comparative example being similar to that of the bottom portion of the developing frame member 310 described in the first embodiment.

In the comparative example, the gate portions 80 are not provided at the bottom portion of the developing frame member 510 in the maximum image area in the area Q of the developing frame member 510, and are provided at the bottom portion of the developing frame member 510 in the maximum image area in the area P of the developing frame member 510, as illustrated in FIGS. 15 and 16. As described above, in the comparative example, the gate portions 80 are provided at the bottom portion of the developing frame member 510 in the maximum image area in the area P of the developing frame member 510, but the positions of the gate portions 80 in the maximum image area of the developing frame member 510 are relatively closer to the maximum image area of the blade attachment portion 41 than that in the first embodiment. Thus, the degree of contribution of the residual stress from the gate portions 80 provided at the bottom portion of the developing frame member 510 in the maximum image area in the area P of the developing frame member 510 to fluctuation in the size of the SB gap G is relatively greater than that in the first embodiment. Specifically, in a state that the resin doctor blade 36 having low stiffness is fixed to the resin developing frame member 510, the degree of fluctuation in the size of the SB gap G due to the residual stress from the gate portions 80 provided at the bottom portion of the developing frame member 510 in the maximum image area in the area P of the developing frame member 510 tends to be increased. As a result, warp deformation of the doctor blade 36 occurs in the direction of an arrow J illustrated in FIG. 16 in association with temporal application of the residual stress from the gate portions 80 provided at the bottom portion of the developing frame member 510 in the maximum image area in the area P of the developing frame member 510 to the developing frame member 510. Then, the center portion of the doctor blade 36 in the longitudinal direction thereof is deflected, and the size of the SB gap G fluctuates.

On the other hand, in the first embodiment, the degree of contribution of the residual stress from the gate portions 80 provided at the bottom portion of the developing frame member 310 in the maximum image area in the area Q of the developing frame member 310 to fluctuation in the size of SB gap G is sufficiently small. Thus, in the first embodiment, no warp deformation occurs at the doctor blade 36 in the direction of the arrow J illustrated in FIG. 16 in association with temporal application of the residual stress from the gate portions 80 provided at the bottom portion of the developing frame member 310 in the maximum image area in the area Q of the developing frame member 310 to the developing frame member 310.

According to the first embodiment described above, the positions of the gate portions 80 are designed such that fluctuation in the size of the SB gap G due to the residual stress from the gate portions 80 is reduced in a state that the resin doctor blade 36 having low stiffness is fixed to the resin developing frame member 310. Specifically, as illustrated in FIGS. 13 and 14, the gate portions 80 are not provided at the bottom portion of the developing frame member 310 in the maximum image area in the area P of the developing frame member 310, and are provided at the bottom portion of the developing frame member 310 in the maximum image area in the area Q of the developing frame member 310. With this configuration, fluctuation in the size of the SB gap G due to the residual stress from the gate portions 80 can be, in the first embodiment, reduced in a state that the resin doctor blade 36 having low stiffness is fixed to the resin developing frame member 310.

Note that in the first embodiment, two gate portions 80 are provided with a spacing at the bottom portion of the developing frame member 310 in the maximum image area in the area Q of the developing frame member 310 as illustrated in FIG. 14. Since the multiple gate portions 80 are provided at the developing frame member 310 as described above, the amount of resin flowing into each gate portion 80 is dispersed proportional to the number of gate portions 80 provided at the developing frame member 310 when the molten resin flows into the gate portions 80 through the gates. Then, the molding pressure on each gate portion 80 is smaller in a case where the number of gate portions 80 provided at the developing frame member 310 is a multiple number than in a case where the number of gate portions 80 provided at the developing frame member 310 is only one. As a result, the residual stress generated from each gate portion 80 is smaller in a case where the number of gate portions 80 provided at the developing frame member 310 is a multiple number than in a case where the number of gate portions 80 provided at the developing frame member 310 is only one.

That is, the multiple gate portions 80 are provided at the bottom portion of the developing frame member 310 in the maximum image area in the area Q of the developing frame member 310, and therefore, the influence of contribution of the residual stress from the gate portions 80 to fluctuation in the size of the SB gap G can be further reduced. Thus, it is advantageous because the influence of contribution of the residual stress from the gate portions 80 to fluctuation in the size of the SB gap G can be further reduced when the number of gate portions 80 provided at the bottom portion of the developing frame member 310 in the maximum image area in the area Q of the developing frame member 310 is not one but a multiple number.

Moreover, in the first embodiment, the gate portions 80 having a greater thickness than the basic thickness of the developing frame member 310 are provided at the bottom portion of the developing frame member 310 in the maximum image area in the area Q of the developing frame member 310 as illustrated in FIG. 14. When the molten resin flows into the gate portions 80 through the gates, the amount of resin flowing in per unit area of the gate portion 80 is dispersed proportional to the size of the sectional area of the gate portion 80 provided at the developing frame member 310. Thus, the molding pressure on each gate portion 80 is smaller in a case where the sectional area of the gate portion 80 provided at the developing frame member 310 is greater than a predetermined value than in a case where the sectional area of the gate portion 80 provided at the developing frame member 310 is equal to or less than the predetermined value. As a result, the residual stress generated from each gate portion 80 is smaller in a case where the sectional area of the gate portion 80 provided at the developing frame member 310 is greater than the predetermined value than in a case where the sectional area of the gate portion 80 provided at the developing frame member 310 is equal to or less than the predetermined value.

That is, the gate portions 80 having a greater thickness than the basic thickness of the developing frame member 310 are provided at the bottom portion of the developing frame member 310 in the maximum image area in the area Q of the developing frame member 310 so that the influence of contribution of the residual stress from the gate portions 80 to fluctuation in the size of the SB gap G can be further reduced. Thus, it is advantageous because the thickness of each gate portion 80 provided at the bottom portion of the developing frame member 310 in the maximum image area in the area Q of the developing frame member 310 is greater than the basic thickness of the developing frame member 310 so that the influence of contribution of the residual stress from the gate portions 80 to fluctuation in the size of the SB gap G can be further reduced.

(Other Embodiments)

The present disclosure is not limited to the above-described embodiment.

Various modifications (including organic combinations of the embodiments) can be made based on the gist of the present disclosure, and are not excluded from the scope of the present disclosure.

In the present embodiment, the image forming device 60 configured to use the intermediate transfer belt 61 as the image bearing member as illustrated in FIG. 1 has been described by way of example, but the present disclosure is not limited to above. The present disclosure is also applicable to an image forming device configured such that a recording medium sequentially directly comes into contact with a photosensitive drum 1 for performing transfer. In this case, the photosensitive drum 1 forms a rotatable image bearing member configured to carry a toner image.

Figure 2:
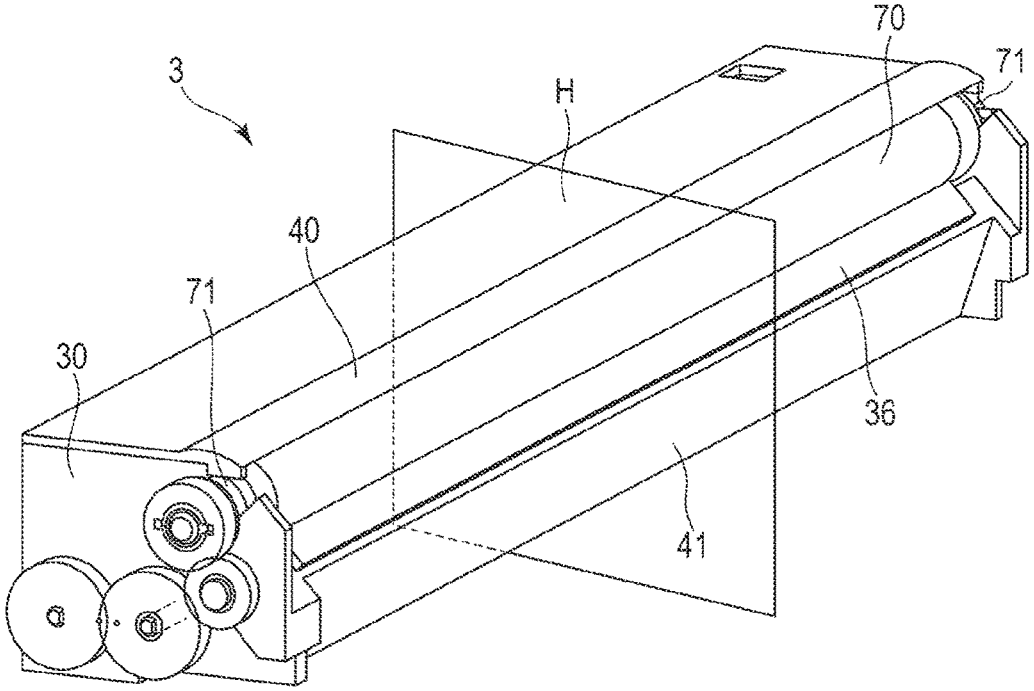
FIG. 2 is a perspective view of a configuration of a developing device.

Moreover, in the above-described embodiment, the developing device 3 configured such that the developing sleeve 70 rotates counterclockwise and the doctor blade 36 is arranged below the developing sleeve 70 as illustrated in FIG. 2 has been described by way of example, but the present disclosure is not limited to above. The present disclosure is also applicable to a developing device 3 (a developing device 300) configured such that a developing sleeve 70 rotates clockwise and a doctor blade 36 is arranged above the developing sleeve 70.

Further, in the above-described embodiment, the developing device 3 (the developing device 300) configured such that the development chamber 31 and the mixing chamber 32 are arranged side by side in the horizontal direction as illustrated in FIG. 2 has been described by way of example, but the present disclosure is not limited to above. The present disclosure is also applicable to a developing device 300 configured such that a development chamber 31 and a mixing chamber 32 are arranged on one another in the direction of gravitational force.

In addition, in the above-described embodiment, the developing device 300 has been described as a single unit, but similar advantageous effects are obtained even in such a process cartridge form that the image forming units 600 (see FIG. 1) including the developing device 3 is integrally unitized and is detachably attachable to the image forming device 60. Further, as long as the image forming device 60 includes the developing device 300 or the process cartridge, the present disclosure is applicable regardless of a black-and-white machine or a color machine.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2017-172337, filed Sep. 7, 2017, and No. 2018-146714, filed Aug. 3, 2018, which are hereby incorporated by reference herein in their entirety.

What is claimed is:

1. A developing device comprising:

a developing rotary member configured to carry and convey a developer toward a position at which an electrostatic image formed on an image bearing member is developed;

a resin regulating blade arranged facing the developing rotary member, the regulating blade including a regulating portion for regulating an amount of the developer carried on the developing rotary member at a position closest to developer rotary member;

a resin developing frame member including an attachment portion for attachment of the regulating blade;

a first conveying screw arranged in a first chamber of the developing frame member in which the developer is supplied to the developing rotary member and configured to convey the developer of the first chamber in a first conveying direction; and a second conveying screw arranged in a second chamber of the developing frame member which is divided from the first chamber by a partition wall and configured to convey the developer of the second chamber in a second conveying direction as an opposite direction of the first conveying direction, wherein the regulating blade is attached to the attachment portion in a state that the regulating blade is warped such that a gap between the developing rotary member supported on the developing frame member and the regulating blade attached to the attachment portion falls within a predetermined range along a rotational axis direction of the developing rotary member, wherein the developing device comprises a portion corresponding to a maximum image region of the image bearing member with respect to the rotational axis direction of the developing rotary member, and wherein in a case where the portion is partitioned into a part of the portion which has the regulating portion and a part of the portion which does not have the regulating portion by a first plane including a rotational axis of the developing rotary member and a rotational axis of the image bearing member, and a part of the portion which has the regulating portion is partitioned into a first part and a second part by a second plane including a rotational axis of the first conveying screw and perpendicular to the first plain, the first part does not have the attachment portion and has a gate portion, and the second part has the attachment portion and does not have a gate portion.

2. The developing device according to claim 1, wherein the regulating blade is, with an adhesive, attached over an entirety of the attachment portion in the second part.

3. The developing device according to claim 1, wherein the first part has all of a plurality of gate portions, and wherein the second part has none of the plurality of gate portions.

4. The developing device according to claim 1, further comprising:

a resin covering frame member that is separate from the developing frame member, wherein the covering frame member covers the first chamber and covers the second chamber.

5. A developing device comprising:

a developing rotary member configured to carry and convey a developer toward a position at which an electrostatic image formed on an image bearing member is developed;

a resin regulating blade arranged facing the developing rotary member, the regulating blade including a regulating portion for regulating an amount of the developer carried on the developing rotary member at a position closest to developer rotary member;

a resin developing frame member including an attachment portion for attachment of the regulating blade;

a first conveying screw arranged in a first chamber of the developing frame member in which the developer is supplied to the developing rotary member and configured to convey the developer of the first chamber in a first conveying direction; and a second conveying screw arranged in a second chamber of the developing frame member which is divided from the first chamber by a partition wall and configured to convey the developer of the second chamber in a second conveying direction as an opposite direction of the first conveying direction, wherein the regulating blade is attached, with adhesive, to the attachment portion, wherein the developing device comprises a portion corresponding to a maximum image region of the image bearing member with respect to a rotational axis direction of the developing rotary member, and wherein in a case where the portion is partitioned into a part of the portion which has the regulating portion and a part of the portion which does not have the regulating portion by a first plane including a rotational axis of the developing rotary member and a rotational axis of the image bearing member, and a part of the portion which has the regulating portion is partitioned into a first part and a second part by a second plane including a rotational axis of the first conveying screw and perpendicular to the first plain, the first part does not have the attachment portion and has a gate portion, and the second part has the attachment portion and does not have a gate portion.

6. The developing device according to claim 5, wherein the regulating blade is, with an adhesive, attached over an entirety of the attachment portion in the second part.

7. The developing device according to claim 5, wherein a thickness size of the gate portion is greater than 1.0 mm.

8. The developing device according to claim 5, wherein the first part has all of a plurality of gate portions, and wherein the second part has none of the plurality of gate portions.

9. The developing device according to claim 8, wherein a thickness size of each of the plurality of gate portions is greater than 1.0 mm.

10. The developing device according to claim 5, wherein the regulating portion is located below the rotational axis of the developing rotary member in a vertical direction.

11. The developing device according to claim 5, wherein a length of the portion corresponding to the maximum image region of the image bearing member with respect to the rotational axis direction of the developing rotary member is a length corresponding to an A3 size.

12. The developing device according to claim 5, further comprising:

a resin covering frame member that is separate from the developing frame member, wherein the covering frame member covers the first chamber and covers the second chamber.

13. The developing device according to claim 5, wherein the regulating blade has a rigidity capable of being warped.

14. A developing device comprising:

a developing rotary member configured to carry and convey a developer toward a position at which an electrostatic image formed on an image bearing member is developed;

a resin regulating blade arranged facing the developing rotary member, the regulating blade including a regulating portion for regulating an amount of the developer carried on the developing rotary member at a position closest to developer rotary member;

a resin developing frame member including an attachment portion for attachment of the regulating blade;

a first conveying screw arranged in a first chamber of the developing frame member in which the developer is supplied to the developing rotary member and configured to convey the developer of the first chamber in a first conveying direction; and a second conveying screw arranged in a second chamber of the developing frame member which is divided from the first chamber by a partition wall and configured to convey the developer of the second chamber in a second conveying direction as an opposite direction of the first conveying direction, wherein the regulating portion is located below a rotational axis of the developing rotary member in a vertical direction, wherein the developing device comprises a portion corresponding to a maximum image region of the image bearing member with respect to the rotational axis direction of the developing rotary member, and wherein in a case where the portion is partitioned into a part of the portion which has the regulating portion and a part of the portion which does not have the regulating portion by a first plane including the rotational axis of the developing rotary member and a rotational axis of the image bearing member, and a part of the portion which has the regulating portion is partitioned into a first part and a second part by a second plane including a rotational axis of the first conveying screw and perpendicular to the first plain, the first part does not have the attachment portion and has a gate portion, and the second part has the attachment portion and does not have a gate portion.

15. The developing device according to claim 14, wherein a thickness size of the gate portion is greater than 1.0 mm.

16. The developing device according to claim 14, wherein the first part has all of a plurality of gate portions, and wherein the second part has none of the plurality of gate portions.

17. The developing device according to claim 16, wherein a thickness size of each of the plurality of gate portions is greater than 1.0 mm.

18. The developing device according to claim 14, wherein a length of the portion corresponding to the maximum image region of the image bearing member with respect to the rotational axis direction of the developing rotary member is a length corresponding to an A3 size.

19. The developing device according to claim 14, further comprising:

a resin covering frame member that is separate from the developing frame member, wherein the covering frame member covers the first chamber and covers the second chamber.

20. The developing device according to claim 14, wherein the regulating blade has a rigidity capable of being warped.

* * * * *